US007661611B2

(12) United States Patent
Kubota et al.

(10) Patent No.: US 7,661,611 B2
(45) Date of Patent: Feb. 16, 2010

(54) TONER AND METHOD FOR PRODUCING THE SAME

(75) Inventors: Kohji Kubota, Sakai (JP); Shoji Watanabe, Sakai (JP); Kohta Wakimoto, Sakai (JP); Nobuyasu Makino, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 243 days.

(21) Appl. No.: 11/752,562

(22) Filed: May 23, 2007

(65) Prior Publication Data

US 2008/0003518 A1 Jan. 3, 2008

(30) Foreign Application Priority Data

Jun. 30, 2006 (JP) ..... 2006-180879
Apr. 26, 2007 (JP) ..... 2007-116697

(51) Int. Cl.
*B02C 19/06* (2006.01)

(52) U.S. Cl. ..... 241/5; 241/19; 241/29; 241/80

(58) Field of Classification Search ..... 241/5, 241/19, 39, 79.1, 80, 29
See application file for complete search history.

(56) References Cited

U.S. PATENT DOCUMENTS

| | | | |
|---|---|---|---|
| 5,016,823 | A | 5/1991 | Kato et al. |
| 5,358,188 | A | 10/1994 | Makino et al. |
| 5,938,045 | A | 8/1999 | Makino et al. |
| 6,368,765 | B2 | 4/2002 | Izu et al. |
| 6,503,681 | B2 | 1/2003 | Makino et al. |
| 7,032,849 | B2 | 4/2006 | Takahashi et al. |
| 7,156,331 | B2 | 1/2007 | Takahashi et al. |
| 2003/0178514 | A1 | 9/2003 | Makino et al. |
| 2005/0003294 | A1 | 1/2005 | Murakami et al. |
| 2005/0112492 | A1 | 5/2005 | Makino et al. |
| 2005/0158648 | A1 | 7/2005 | Makino et al. |
| 2006/0024607 | A1 | 2/2006 | Tanaka et al. |
| 2006/0032952 | A1 | 2/2006 | Kawamoto et al. |
| 2006/0063091 | A1 | 3/2006 | Makino et al. |
| 2006/0214036 | A1 | 9/2006 | Makino |
| 2006/0222980 | A1 | 10/2006 | Makino et al. |
| 2007/0031754 | A1 | 2/2007 | Murakami et al. |

FOREIGN PATENT DOCUMENTS

| | | |
|---|---|---|
| EP | 0 265 910 A2 | 5/1988 |
| EP | 1 091 257 A1 | 4/2001 |
| JP | 6-66034 | 8/1994 |
| JP | 2851872 | 11/1998 |
| JP | 11-15194 | 1/1999 |
| JP | 2003-275685 | 9/2003 |
| JP | 3748555 | 12/2005 |

*Primary Examiner*—Mark Rosenbaum
(74) *Attorney, Agent, or Firm*—Oblon, Spivak, McClelland, Maier & Neustadt, L.L.P.

(57) ABSTRACT

To provide a method for producing a toner, containing a milling step containing finely milling particles and classifying coarse particles by using at least a mill and a cyclone unit, and a classifying step containing classifying pulverized particles by using at least a classifier and a cyclone unit, wherein any of the pulverized particles and other particles, which are classified by the classifier in the classifying step and returned, are returned to the cyclone unit in the milling step, and a toner produced by the method for producing the toner.

20 Claims, 13 Drawing Sheets

TONER AND METHOD FOR PRODUCING THE SAME

BACKGROUND OF THE INVENTION

1. Field of the Invention

The present invention relates to a method for producing a toner and a toner produced by the method which is excellent in productivity and economic efficiency, in which in a milling and classifying step of the toner, pulverized particles contained more than required in the toner as a product are accurately classified, and the toner having excellent quality property can be stably and easily produced.

2. Description of the Related Art

Conventionally, for the method for milling and classifying the toner (1) a pair of a classifier and a mill or two or more pairs thereof, (2) a combination of two classifiers and a mill or the like have been proposed (Japanese Patent (JP-B) No. 2851872, Japanese Patent Application Publication (JP-B) No. 6-66034, Japanese Patent Application Laid-Open (JP-A) Nos. 2003-275685 and 11-15194, and JP-B No. 3748555). For example, a jet mill unit, so called jet mill, in which high pressure airflow is blown out from a jet nozzle to involve raw material particles therein, and then the particles collide each other, or collide to a wall or other impactor. In the jet mill, at first particles are milled by one or two milling units and two classifying units of coarse particles, and then pulverized particles are classified by at least one classifying unit.

FIG. 1 shows an example of a flow diagram of the milling and classifying step of the conventional toner. In the flow shown in FIG. 1, a raw material is supplied from a raw material supply part 1, introduced to a first classifier 2, and then classified into coarse particles and pulverized particles. The pulverized particles are recovered in a first cyclone unit 4, while the coarse particles are milled in a first mill 3 and then once recovered in the first cyclone unit 4. Next, the particles in the first cyclone unit 4 is introduced to a second classifier 6, and then classified into coarse particles and pulverized particles. The pulverized particles are recovered in a second cyclone unit 8, while the coarse particles are milled in the second mill 7, and then recovered in the second cyclone unit 8. The particles in the second cyclone unit 8 are introduced to a third classifier 10 and classified into coarse particles and pulverized particles. The coarse particles are recovered as a toner product 11, while the pulverized particles are once recovered in a third cyclone unit 12, and then further classified into coarse particles and pulverized particles in the fourth classifier 13. The pulverized particles are recovered in a fourth cyclone unit 14, while the coarse particles are returned to the third classifier 10 through a return pipe 13*a*, and the classification is repeated until the desired particle size is obtained. The pulverized particles are collected in the fourth cyclone unit 14 as a pulverized particles 16. Moreover, the pulverized particles are collected from the upper part of the third cyclone unit 12 and the fourth cyclone unit 14 as well as the upper part of the third classifier 10 and the fourth classifier 13 by the third collector 15. The collected pulverized particles are granulated and used or directly used again as a kneading product.

In the flow of the milling and classifying step shown in FIG. 1, the coarse particles classified in the fourth classifier 13 are returned to the third classifier 10, thus a burden to the third classifier 10 is increased. Moreover, because the amount of the particles returned from the fourth classifier 13 is not constant, the classified density of the third classifier 10 fluctuates, the stable particle diameter distribution cannot be obtained and the accuracy of classification may be decreased.

When the toner obtained by the above-mentioned flow of the milling and classifying step is used to form an image, background smear may occur due to unstable image density and charge amount, and image quality may be decreased due to transfer failure.

To obtain a desired toner particle size, excessive removal of pulverized particles leads to the reduction of a yield of toner product. As a result, the amount of the collected pulverized particles is increased, and force loading for reuse is increased, and economic disadvantages may be invited, for example, worse productive energy efficiency, cost rise, and production of excess $CO_2$.

BRIEF SUMMARY OF THE INVENTION

The object of the present invention is to provide a method for producing a toner and a toner produced by the method which is excellent in productivity and economic efficiency in which in a milling and classifying step of the toner (finely milling particles and classifying coarse particles, classifying pulverized particles), pulverized particles contained more than required in the toner as a product are accurately classified in the step, the toner having excellent quality property can be produced stably and easily.

The above-mentioned problems can be solved as follows:

<1>A method for producing a toner, containing a milling step containing finely milling particles and classifying coarse particles by using at least a mill and a cyclone unit, and a classifying step containing classifying pulverized particles by using at least a classifier and a cyclone unit, wherein any of the pulverized particles and other particles, which are classified by the classifier in the classifying step and returned, are returned to the cyclone unit in the milling step.

<2> The method for producing a toner according to <1>, wherein at least a mill, a cyclone unit and a classifier are used in the milling step.

<3> The method for producing a toner according to any of <1> to <2>, wherein the cyclone unit contains at least a cyclone.

<4> The method for producing a toner according to any of <1> to <3>, wherein the amount of the particles in the cyclone unit to which the particles are returned is 15% to 35% of the total volume of the cyclone unit.

<5> The method for producing a toner according to any of <1> to <4>, wherein a particles introducing pipe contains a narrowing part in the classifier in the classifying step, and a cross section of the particles introducing pipe A1 and a cross section of the narrowing part A2 satisfy the following relation:

$$1\times(A1/20)\leqq A2\leqq 10\times(A1/20).$$

<6> The method for producing a toner according to any of <1> to <5>, wherein a return pipe returning the particles to the cyclone unit contains a narrowing part, and a cross section of the return pipe B1 and a cross section of the narrowing part B2 satisfy the following relation:

$$1\times(B1/20)\leqq B2\leqq 10\times(B1/20).$$

<7> The method for producing a toner according to any of <1> to <6>, wherein an upper suction pipe of the cyclone unit to which the particles are returned contains a narrowing part, and a cross section of the upper suction pipe D1 and a cross section of the narrowing part D2 satisfy the following relation:

$$1\times(D1/20)\leqq D2\leqq 10\times(D1/20).$$

<8> The method for producing a toner according to any of <1> to <7>, wherein a cross section of the cylindrical part of the cyclone unit to which the particles are returned C1 and a cross section of the return pipe returning the particles to the cyclone unit C2 satisfy the following relation:

$$1\times(C1/2000)\leqq C2\leqq 200\times(C1/2000).$$

<9> The method for producing a toner according to any of <1> to <8>, wherein the insert angle θ of the return pipe returning the particles to the cyclone unit relative to the vertical perpendicular line to the insert position where the return pipe is inserted to the cyclone unit is 30° to 150°.

<10> The method for producing a toner according to any of <1> to <9>, wherein the height L1 from the bottom of the conical part to the top of the cylindrical part in the cyclone unit to which the particles are returned, and the height L2 from the insert position of the return pipe returning the particles to the cyclone unit to the top of the cylindrical part of the cyclone unit satisfy the following relation:

$$1\times(L1/10)\leqq L2\leqq 9\times(L1/10).$$

<11> The method for producing a toner according to any of <1> to <10>, wherein the amount of the particles in the cyclone unit to which the particles are returned is adjusted by a secondary air from a secondary air pipe disposed on the cyclone unit.

<12> The method for producing a toner according to <11>, wherein a position where the secondary air pipe is disposed on the cyclone unit to which the particles are returned is higher than any of a position where the return pipe is disposed on the cyclone unit and a surface of the particles in the cyclone unit.

<13> The method for producing a toner according to any of <1> to <12>, wherein the amount of the particles in the cyclone unit to which the particles are returned is adjusted by a blower flow of a collector located above the cyclone unit, and the blower flow is 70% or more of the maximum flow.

<14> The method for producing a toner according to any of <1> to <13>, wherein the amount of the particles in the cyclone unit to which the particles are returned is adjusted by a compression air pressure from the classifier in the classifying step, and the compression air pressure is 0.2 MPa to 0.6 MPa.

<15> The method for producing a toner according to any of <1> to <14>, wherein the amount of the particles in the cyclone unit to which the particles are returned is adjusted by a flow rate of compression air from the classifier in the classifying step, and the flow rate of compression air is 0.5 $m^3$/min to 2.5 $m^3$/min.

<16> The method for producing a toner according to any of <1> to <15>, wherein the amount of the particles in the cyclone unit to which the particles are returned is adjusted by a static pressure, and a primary static pressure of the upper part of the cyclone unit P1 is −10 kPa to −30 kPa.

<17> The method for producing a toner according to any of <1> to <16>, wherein the amount of the particles in the cyclone unit to which the particles are returned is adjusted by the static pressure, and the pressure difference ΔP (|P1−P2|) between the primary static pressure of the upper part of the cyclone unit P1 and a secondary static pressure of the lower part of the cyclone unit P2 is 5 kPa or less.

<18> The method for producing a toner according to any of <16> to <17>, wherein the static pressure in the cyclone unit to which the particles are returned is adjusted by a secondary air flow rate, and the secondary air flow rate is 300 L/min to 1,200 L/min.

<19> The method for producing a toner according to <18>, wherein the secondary air flow rate in the cyclone unit to which the particles are returned is adjusted by an automatic adjustment device.

<20> The method for producing a toner according to <19>, wherein the automatic adjustment device contains a cleaning mechanism.

<21> The method for producing a toner according to any of <1> to <20>, wherein the particles returned to the cyclone unit have a mass average particle diameter of 5.5 μm or less, a number average particle diameter of 4.5 μm or less, and a content of the pulverized particles having a particle diameter of 4.0 μm or less of 40 number average % or more.

<22> The method for producing a toner according to any of <1> to <21>, wherein the particles collected from the upper part of the cyclone unit to which the particles are returned have a mass average particle diameter of 4.0 μm or less, a number average particle diameter of 3.0 μm or less, and a content of the pulverized particles having a particle diameter of 4.0 μm or less of 70 number average % or more.

<23> A toner produced by the method for producing the toner according to any of <1> to <22>.

<24> The toner according to <23>, wherein the content of the pulverized particles having a particle diameter of 4.0 μm or less is 5 number average % to 25 number average %.

<25> The toner according to any of <23> to <24>, wherein the toner has a mass average particle diameter of 5.0 μm to 12.0 μm, and a number average particle diameter of 4.0 μm to 11.0 μm.

The method for producing the toner, contains a milling step and classifying step, wherein the milling step containing finely milling particles and classifying coarse particles by using at least a mill and at least a cyclone unit, and the classifying step containing classifying pulverized particles by using at least a classifier and at least a cyclone unit, wherein any of the pulverized particles and other particles, which are classified by the classifier in the classifying step and returned, are returned to the cyclone unit in the milling step. Consequently, in the milling and classifying step of the toner (finely milling particles and classifying coarse particles, classifying pulverized particles), the pulverized particles contained more than required in the toner as a product are accurately classified without adding a classifier in the step, by giving an additional function to the present condition. Therefore, the method for producing the toner is excellent in productivity and economic efficiency and the toner having excellent quality property can be stably and easily produced by using the method.

DETAILED DESCRIPTION OF THE INVENTION

Method for Producing Toner and Toner

Figure 1:
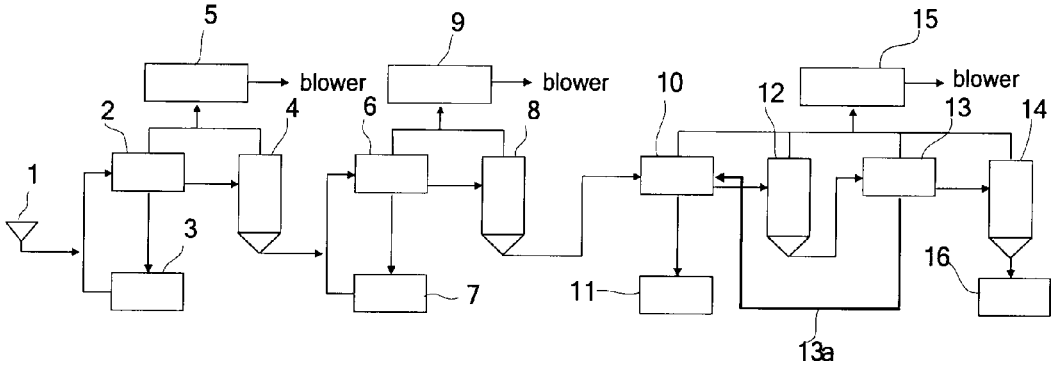
FIG. 1 shows an example of the flow of the conventional milling and classifying step.

A method for producing a toner of the present invention contains at least a milling step and classifying step, and a melt-kneading step, and further contains other steps as necessary.

The milling step is a step of finely milling particles and classifying coarse particles by using at least a mill and at least a cyclone unit, and preferably a step of finely milling particles and classifying coarse particles by using at least a mill, at least a cyclone unit and at least a classifier.

The classifying step is a step of classifying pulverized particles by using at least a classifier and at least a cyclone unit.

In the present invention, any of the pulverized particles and other particles, which are classified by means of the classifier in the classifying step and returned, are returned to the cyclone unit in the milling step.

A toner of the present invention is produced by the method for producing the toner of the present invention.

The details of the toner of the present invention will be explained by illustrating the method for producing the toner of the present invention hereinbelow.

<Milling Step and Classifying Step>

In the milling step, at least a mill is used, and preferably two or more mills are used. The mill is not limited, and may be appropriately selected depending on the purpose. Examples of the mills include an impact mill, and a jet mill.

Examples of the impact mills include a turbomill by Turbo Kogyo Co., Ltd., and a Kryptron by Earth Technica Co., Ltd.

Examples of the jet mills include a supersonic jet mill PJM-I, and an IDS by Nippon Pneumatic Mfg. Co., Ltd., a counter jet mill by Hosokawa Micron Ltd., and a cross jet mill by Kurimoto, Ltd.

In the milling and classifying step, at least a classifier is user, and preferably two or more classifiers are used. The classifier is not limited and may be appropriately selected depending on the purpose. Examples of the classifiers using swirling current include a DS classifier by Nippon Pneumatic Mfg. Co., Ltd.; a Duplex (ATP) separator, a micron separator, a toner separator, and a tandem toner separator by Hosokawa Micron Ltd.; a Donaselec classifier by NIPPON DONALDSON, LTD.; and a turboclassifier by Nisshin Engineering Inc.

In the milling and classifying step, the cyclone unit has at least a cyclone, and preferably tow or more cyclones. Examples thereof include a double cyclone, a triple cyclone and a multi cyclone of quad or more cyclones.

A cyclone constituting the cyclone unit contains an upper cylindrical part (also referred to as an external cylinder) and a lower conical part, and the cyclone to which the particles are returned has a return pipe connected to the side of the conical part.

The cyclone is not limited and may be appropriately selected depending on the purpose. Examples thereof include a tangential cyclone, a tangential double cyclone, and a lindane-type cyclone.

In the present invention, "pulverized particles" means pulverized particles having a diameter of 4.0 μm or less, and "other particles" means particles other than the pulverized particles having a diameter of 4.0 μm or less.

In the method for producing the toner of the invention, the particles which are returned to the cyclone unit in the milling step preferably have a mass average particle diameter of 5.5 μm or less and a number average particle diameter of 4.5 μm or less, and a content of the pulverized particles having a particle diameter of 4.0 μm or less of 40 number average % or more, because the accuracy of classification can be improved by removing again pulverized particles and rerecovering coarse particles.

The particles collected from the upper part of the cyclone unit to which the particles are returned in the milling step preferably has a mass average particle diameter of 4.0 μm or less and a number average particle diameter of 3.0 μm or less, and a content of the pulverized particles having a particle diameter of 4.0 μm or less of 70 number average % or more, because the load to the classifier may be decreased and the accuracy of classification can be improved.

Figure 2:
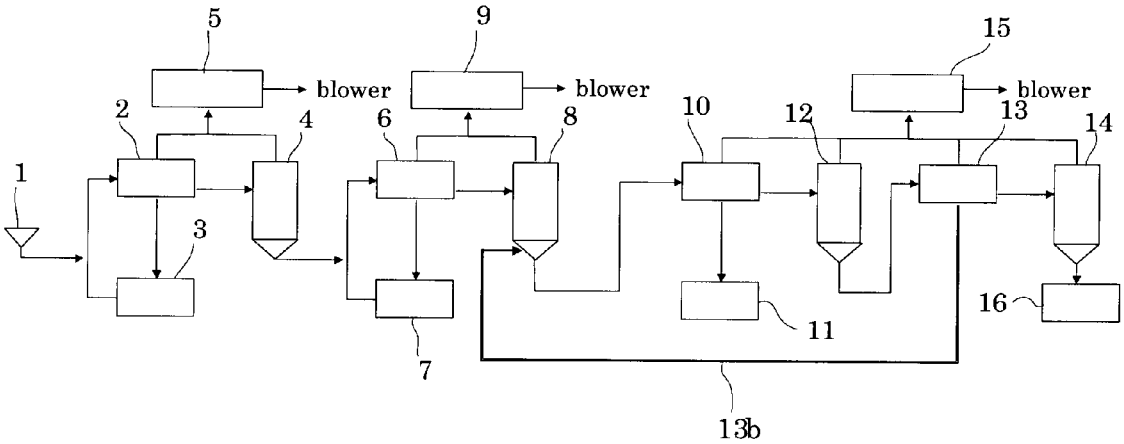
FIG. 2 shows an example of the flow of the milling and classifying step in Example 1.

The method for producing the toner of the invention will be illustrated hereinbelow with reference to the drawings. FIG. 2 shows an example of the flow of the milling and classifying step of the invention.

In FIG. 2, a return pipe 13*a* returning at least any of the pulverized particles and other particles, which are classified in a fourth classifier 13 in the classifying step and returned to a third classifier 10 in the classifying step in the conventional flow of the milling and classifying step shown in FIG. 1 is replaced by a return pipe 13*b*, which returns the particles to a second cyclone unit 8 in the milling step. Thus, the fluctuation of the classified density (ratio of solid to gas) in the third classifier 10 is reduced compared to the conventional method, and the accuracy of classification can be stabilized.

In FIGS. 2, 5, 9, and 15 denote respectively a first collector, a second collector, and a third collector.

In the flow of the milling and classifying step shown in FIG. 2, the amount of the particles in the second cyclone unit 8 to which the particles are returned in the milling step are adjusted to be at constant amount.

The amount of the particles in the second cyclone unit 8 to which the particles are returned is preferably adjusted to be 15% to 35%, more preferably 20% to 30%, and still more preferably 22% to 28% of the total volume of the cyclone unit in terms of the improvement of classification performance. When the amount of the particles are less than 15%, the amount of the pulverized particles may be decreased because the pulverized particles are collected in a second collector 9 located above the second cyclone unit 8, and then, the content of the pulverized particles in a toner product may be increased. When the amount of the particles are more than 35%, the amount of the pulverized particles collected in the second collector 9 located above the second cyclone unit 8 may be increased and the content of the pulverized particles in a toner product may be decreased, but collection rate may be lowered.

Examples of the method for adjusting the amount of the particles in the second cyclone unit to which the particles are returned in the milling step include (1) adjustment of a blower flow of a collector, (2) adjustment of a compression air pressure, (3) adjustment by a static pressure, (4) adjustment by a secondary air flow rate, (5) adjustment of a flow rate of compression air, (6) adjustment of a cross section of a narrowing part of a particles introducing pipe in a classifier, (7) adjustment of a cross section of a return pipe of a cyclone unit, (8) adjustment of a cross section of an upper suction pipe of a cyclone unit, (9) adjustment of an insert angle of a return pipe to a cyclone unit, and (10) adjustment of an insert position of a return pipe to a cyclone unit, as referred to hereinbelow.

Figure 3:
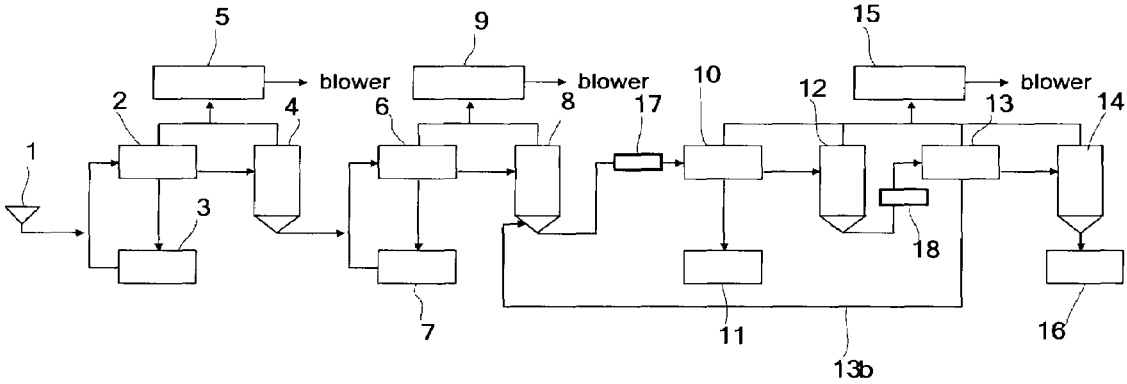
FIG. 3 shows an example of the flow of the milling and classifying step in Example 3.

Next, the flow of the milling and classifying step shown in FIG. 3 is the same as the flow of the milling and classifying step shown in FIG. 2, except that a narrowing part 17 is disposed in the particles introducing pipe of a third classifier 10 in the classifying step, and a narrowing part 18 is disposed in the particles introducing pipe of a fourth classifier 13 in the classifying step.

Figure 4:
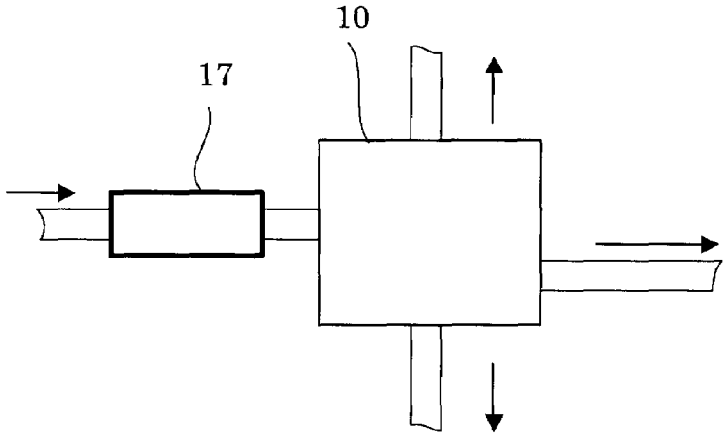
FIG. 4 shows an enlarged view of the third classifier and the narrowing part in FIG. 3.
Figure 6:
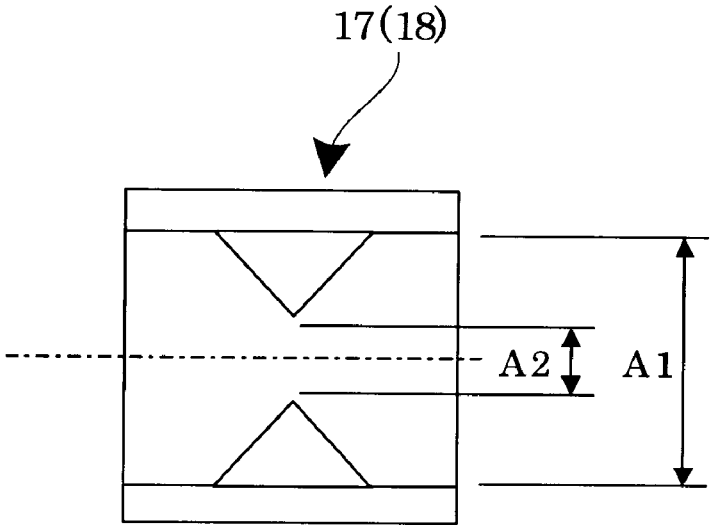
FIG. 6 shows an enlarged view of the narrowing part in FIGS. 4 and 5.

In the flow of the milling and classifying step shown in FIG. 3, the narrowing part 17 is disposed in the particles introducing pipe of the third classifier 10 as shown in FIG. 4. As shown in FIG. 6 a cross section of the particles introducing pipe A1 and a cross section of the narrowing part A2 preferably satisfy the following relation: $1\times(A1/20)\leqq A2\leqq 10\times(A1/20)$, and more preferably satisfy the following relation: $4\times(A1/20)\leqq A2\leqq 6\times(A1/20)$. When the cross section of the narrowing part A2 is less than $1\times(A1/20)$, the return pipe may be clogged and the particles cannot be supplied. When the cross section of the narrowing part A2 is more than $10\times(A1/20)$, the dispersing ability may be decreased and a yield may not be improved.

Figure 5:
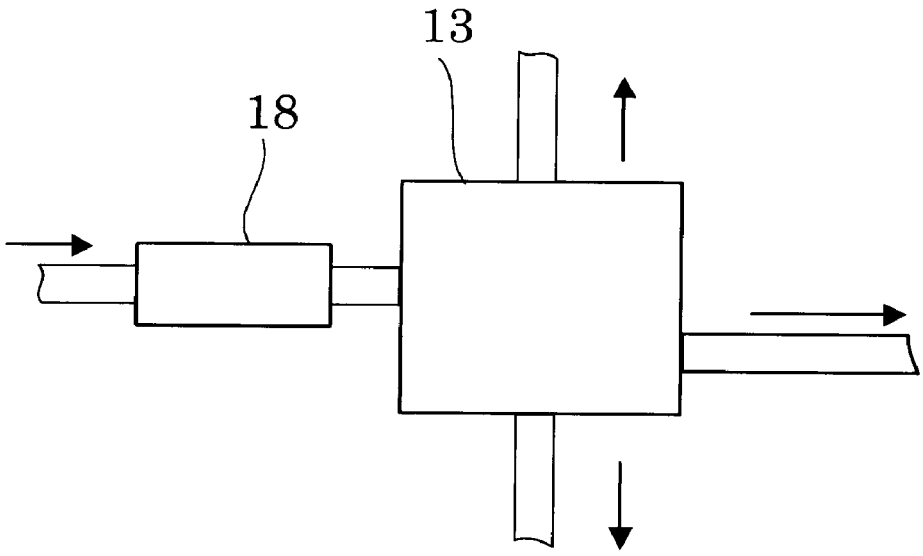
FIG. 5 shows an enlarged view of the fourth classifier and the narrowing part in FIG. 3.

As shown in FIG. 5 the narrowing part 18 is disposed in the particles introducing pipe of the fourth classifier 13, and as shown in FIG. 6 the cross section of the particles introducing pipe A1 and the cross section of the narrowing part A2 preferably satisfy the following relation: $1\times(A1/20)\leqq A2\leqq 10\times(A1/20)$, and more preferably satisfy the following relation: $4\times(A1/20)\leqq A2\leqq 6\times(A1/20)$. When the cross section A2 of the narrowing part is less than $1\times(A1/20)$, the return pipe may be clogged and the particles cannot be supplied. When the cross section A2 of the narrowing part is more than $10\times(A1/20)$, the dispersing ability may be decreased and a yield may not be improved.

Figure 7:
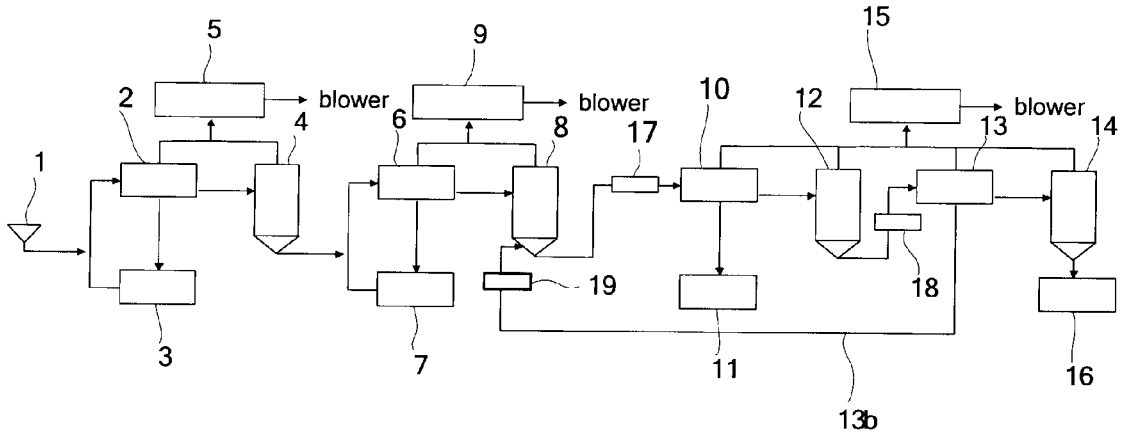
FIG. 7 shows an example of the flow of the milling and classifying step in Example 4.

Next, the flow of the milling and classifying step shown in FIG. 7 is the same as the flow of the milling and classifying step shown in FIG. 3, except that a narrowing part 19 is disposed in the return pipe 13*b* returning the particles from the fourth classifier 13 in the classifying step to the second cyclone unit 8.

Figure 8:
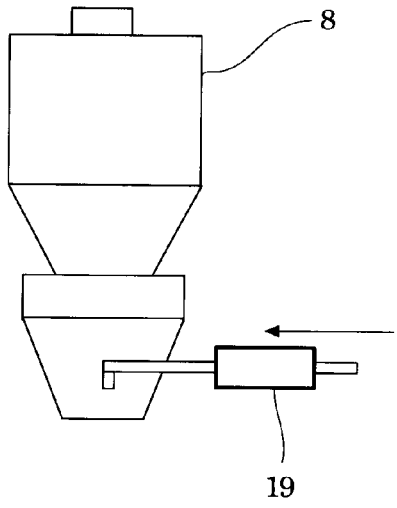
FIG. 8 shows an enlarged view of the second cyclone unit and the narrowing part in FIG. 7.
Figure 9:
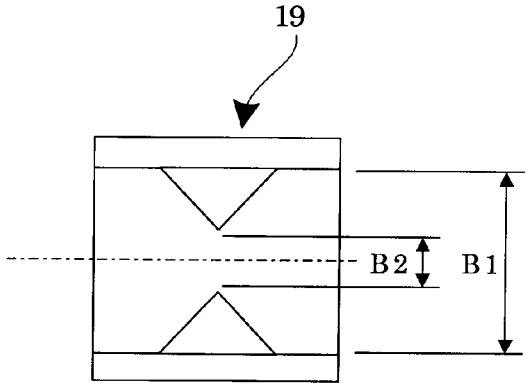
FIG. 9 shows an enlarged view of the narrowing part in FIG. 8.

In the flow of the milling and classifying step shown in FIG. 7, a narrowing part 19 is disposed in the return pipe 13*b* returning the particles to the second cyclone unit 8 as shown in FIG. 8. As shown in FIG. 9, the cross section of the return pipe B1 and the cross section of the narrowing part B2 preferably satisfy the following relation: $1\times(B1/20)\leqq B2\leqq 10\times(B1/20)$, and more preferably satisfy the following relation: $4\times(B1/20)\leqq B2\leqq 6\times(B1/20)$. When the cross section of the narrowing part B2 is less than $1\times(B1/20)$, the return pipe may be clogged and the particles cannot be supplied. When the cross section of the narrowing part B2 is more than $10\times(B1/20)$, the dispersing ability may be decreased and a yield may not be improved.

Figure 10:
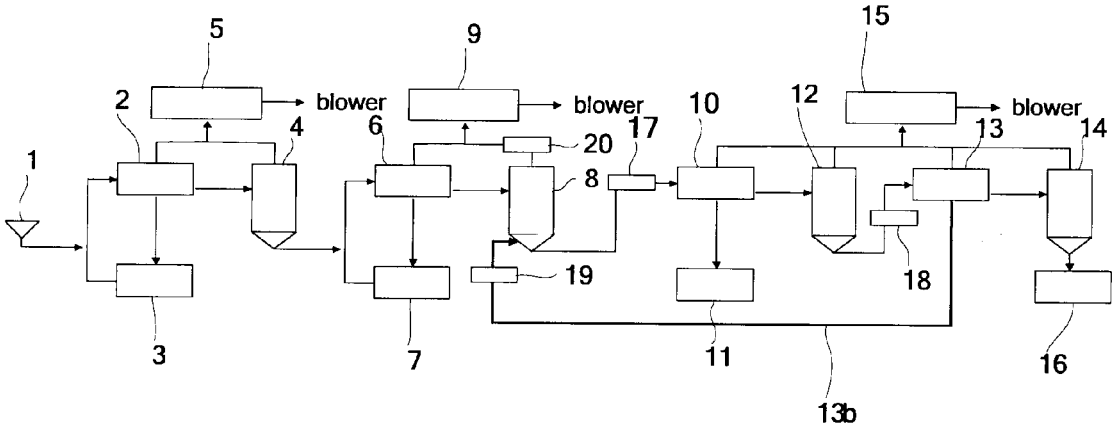
FIG. 10 shows an example of the flow of the milling and classifying step in Example 5.

Next, the flow of the milling and classifying step shown in FIG. 10 is the same as the flow of the milling and classifying step shown in FIG. 7, except that a narrowing part 20 is disposed in the upper suction pipe of the second cyclone unit 8 to which the particles are returned.

Figure 11:
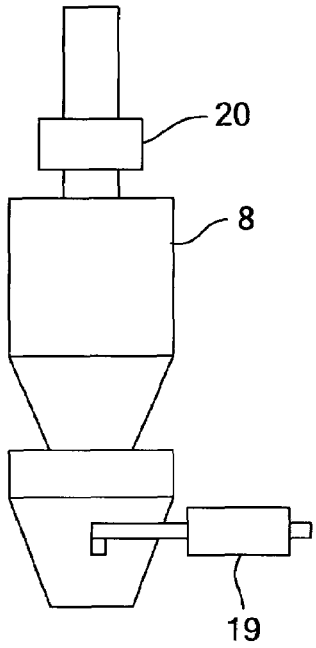
FIG. 11 shows an enlarged view of the second cyclone unit and the narrowing part in FIG. 10.
Figure 12:
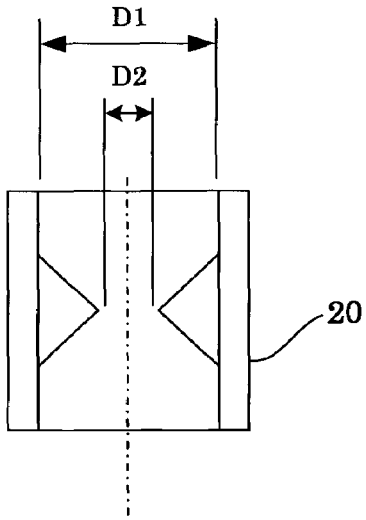
FIG. 12 shows an enlarged view of the narrowing part in FIG. 11.

In the flow of the milling and classifying step shown in FIG. 10, the narrowing part 20 is disposed in the upper suction pipe of the second cyclone unit 8 as shown in FIG. 11. As shown in FIG. 12, the cross section of the return pipe D1 and the cross section of the narrowing part D2 preferably satisfy the following relation: $1\times(D1/20)\leqq D2\leqq 10(D1/20)$, and more preferably satisfy the following relation: $4\times(D1/20)\leqq D2\leqq 6\times(D1/20)$. When the cross section of the narrowing part D2 is less than $1\times(D1/20)$, the upper suction pipe may be clogged and the particles cannot be recovered in the second cyclone unit 8. When the cross section of the narrowing part D2 is more than $10\times(D1/20)$, the dispersing ability may be decreased and a yield may not be improved.

Figure 13:
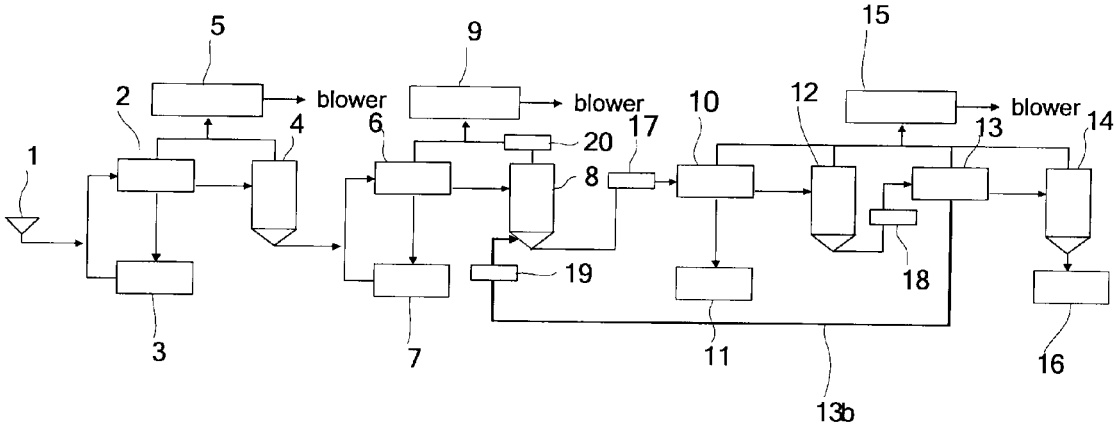
FIG. 13 shows an example of the flow of the milling and classifying step in Examples 6 to 8.

Next, the flow of the milling and classifying step shown in FIG. 13 is the same as the flow of the milling and classifying step shown in FIG. 7, except that the narrowing part 20 is disposed in the upper suction pipe of the second cyclone unit 8 to which the particles are returned.

Figure 14:
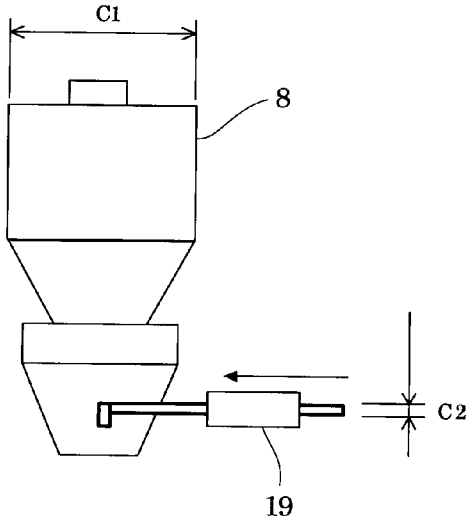
FIG. 14 shows an enlarged view of the second cyclone unit and the narrowing part in FIG. 13.

In the flow of the milling and classifying step shown in FIG. 13, as shown in FIG. 14 the cross section of the cylindrical part of the second cyclone unit 8 is defined as C1, the cross section of the return pipe returning the particles to the second cyclone unit 8 is defined as C2, and C1 and C2 preferably satisfy the following relation: $1\times(C1/2000)\leqq C2\leqq 200\times(C1/2000)$, and more preferably satisfy the following relation: $100\times(C1/2000)\leqq C2\leqq 200\times(C1/2000)$. When the cross section of the return pipe C2 is less than $1\times(C1/2000)$, the return pipe may be clogged and the particles cannot be supplied. When the cross section of the return pipe C2 is more than $200\times(C1/2000)$, the pulsation in the return pipe may be larger, and the content of the pulverized particles in the product may exhibit large variation.

Figure 15:
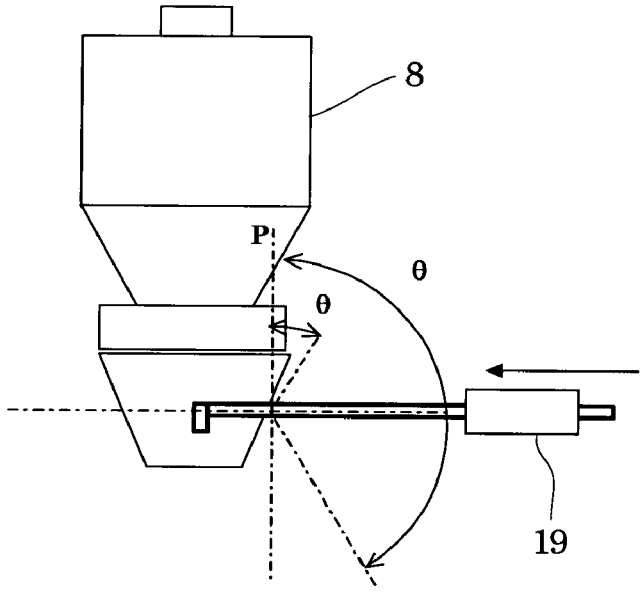
FIG. 15 shows an another enlarged view of the second cyclone unit and the narrowing part in FIG. 13.

In the flow of the milling and classifying step shown in FIG. 13, as shown in FIG. 15 the insert angle θ of the return pipe returning the particles to the second cyclone unit 8 relative to the vertical perpendicular line P to the insert position where the return pipe is inserted to the second cyclone unit 8 is preferably 30° to 15°, and more preferably 30° to 90°. When the insert angle θ is less than 30°, the toner particles in the lower part of the second cyclone unit 8 may soar, and the second collector 9 located above the second cyclone unit 8 may collect the toner particles and a yield may be decreased. When the insert angle θ is more than 150°, the second collector 9 located above the second cyclone unit 8 may collect the toner particles and a yield may be decreased as well.

Figure 16:
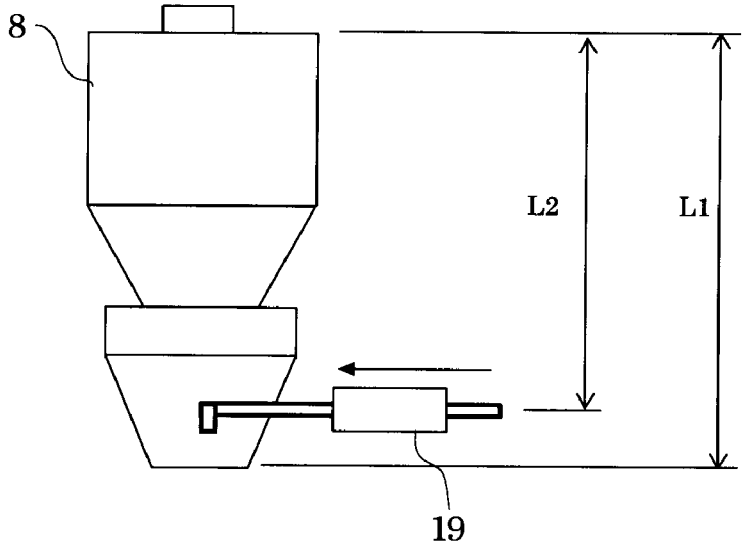
FIG. 16 shows a still another enlarged view of the second cyclone unit and the narrowing part in FIG. 13.

In the flow of the milling and classifying step shown in FIG. 13, as shown in FIG. 16, the height from the bottom of the conical part to the top of the cylindrical part in the second cyclone unit 8 to which the particles are returned is defined as L1, the height from the insert position where the return pipe is inserted to the second cyclone unit 8 to the top of the cylindrical part of the second cyclone unit 8 is defined as L2, and L1 and L2 preferably satisfy the following relation: $1\times(L1/10)\leqq L2\leqq 9\times(L1/10)$, and more preferably satisfy the following relation: $1\times(L1/10)\leqq L2\leqq 3\times(L1/10)$. When L2 is less than $1\times(L1/10)$, the toner particles in the lower part of the second cyclone unit 8 may soar, and the second collector 9 located above the second cyclone unit 8 may collect the toner particles and a yield may be decreased. When L2 is more than $9\times(L1/10)$, the second collector 9 located above the second cyclone unit 8 may collect the toner particles and a yield may be decreased.

Figure 17:
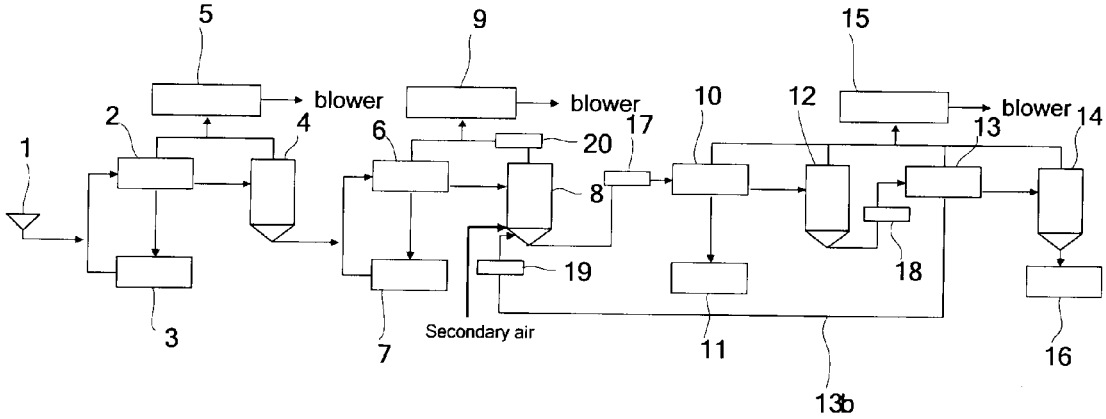
FIG. 17 shows an example of the flow of the milling and classifying step in Example 9.

In the flow of the milling and classifying step shown in FIG. 17 is the same as the flow of the milling and classifying step shown in FIG. 13, except that the amount of the particles in the second cyclone unit 8 to which the particles are returned is adjusted by secondary air from a secondary air pipe disposed on the second cyclone unit 8.

In the flow of the milling and classifying step shown in FIG. 17, the amount of the particles in the second cyclone unit 8 to which the particles are returned is preferably adjusted by the secondary air of atmospheric pressure from the secondary air pipe disposed on the cyclone unit 8. The classification performance is improved by adjusting the amount of the particles using the secondary air.

Figure 18:
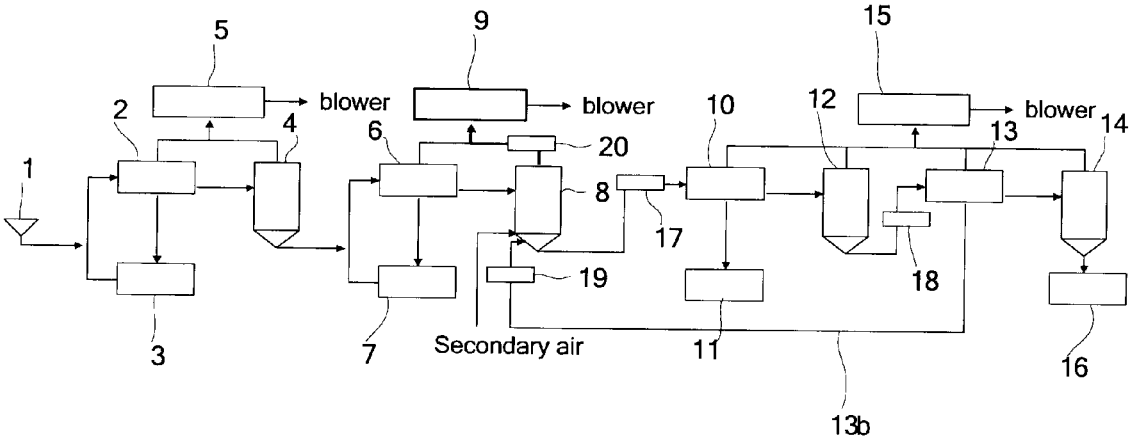
FIG. 18 shows an example of the flow of the milling and classifying step in Example 10.

In the flow of the milling and classifying step shown in FIG. 18 is the same as the flow of the milling and classifying step shown in FIG. 17, except that amount of the particles in the second cyclone unit 8 to which the particles are returned is adjusted by the blower flow in the second collector 9.

In the flow of the milling and classifying step shown in FIG. 18, the amount of the particles in the second cyclone unit 8 to which the particles are returned is preferably adjusted by the blower flow in the second collector 9. The blower flow in the second collector 9 is preferably adjusted to 70% or more, and more preferably 85% or more of the maximum flow in terms of the improvement of classification performance. When the blower flow is less than 70% of the maximum flow, the classification performance may be decreased.

Figure 19:
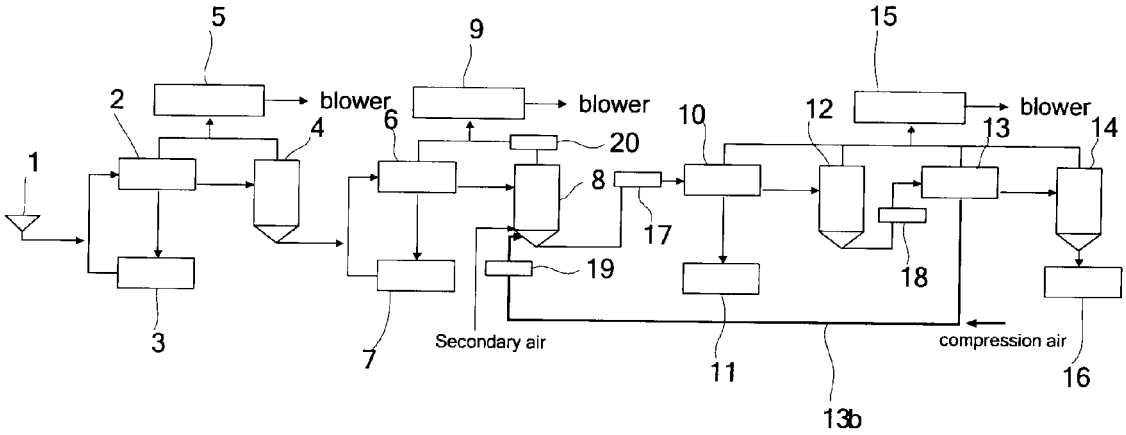
FIG. 19 shows an example of the flow of the milling and classifying step in Examples 11 to 14.

Next, in the flow of the milling and classifying step shown in FIG. 19 is the same as the flow of the milling and classifying step shown in FIG. 18, except that the amount of the particles in the second cyclone unit 8 to which the particles are returned is adjusted by compression air.

In the flow of the milling and classifying step shown in FIG. 19, the amount of the particles in the second cyclone unit 8 to which the particles are returned is preferably adjusted by compression air from the fourth classifier 13 in the classifying step. The compression air pressure (flow rate) is preferably 0.2 MPa to 0.6 MPa (0.5 $m^3$/min to 2.5 $m^3$/min), and more preferably 0.4 MPa to 0.6 MPa (1.5 $m^3$/min to 2.5 $m^3$/min) in terms of the improvement of classification performance. When the compression air pressure (flow rate) is less than 0.2 MPa (0.5 $m^3$/min), the return pipe may be clogged and the particles cannot be supplied. When the compression air pressure (flow rate) is more than 0.6 MPa (2.5 $m^3$/min), the dispersing ability may be decreased and a yield may not be improved.

Figure 20:
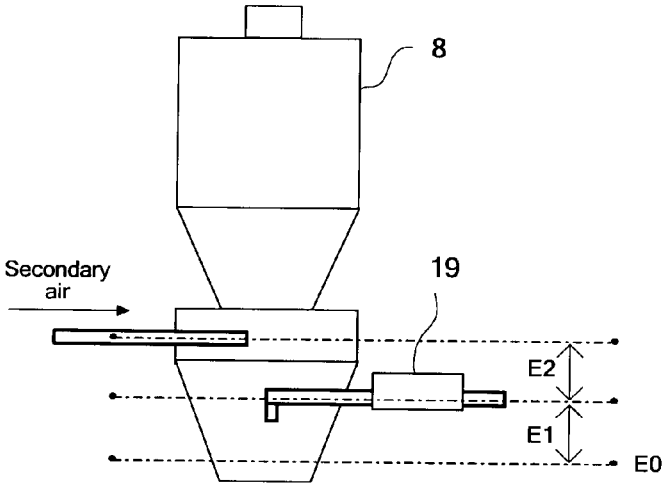
FIG. 20 shows an enlarged view of the second cyclone unit and the narrowing part in FIG. 19.

In the flow of the milling and classifying step shown in FIG. 19, as shown in FIG. 20 a position E2, where the secondary air pipe of atmospheric pressure is disposed on the second cyclone unit 8 to which the particles are returned, is preferably higher than any of a position E1 where the return pipe is disposed on the second cyclone unit 8, and a surface of the particles E0 of the particles in the second cyclone unit 8 to which the particles are returned. Specifically, E1, E2, and E3 more preferably satisfy the following relation: $E0<100\text{ mm}+E1\leqq 100\text{ mm}+E2$, and still more preferably satisfy the following relation: $E0<50\text{ mm}+E1\leqq 50\text{ mm}+E2$, in terms of the improvement of classification performance.

The surface of the particles in the second cyclone unit means that the top surface of the particles which are recovered in the second cyclone unit and gravity settled.

Figure 21:
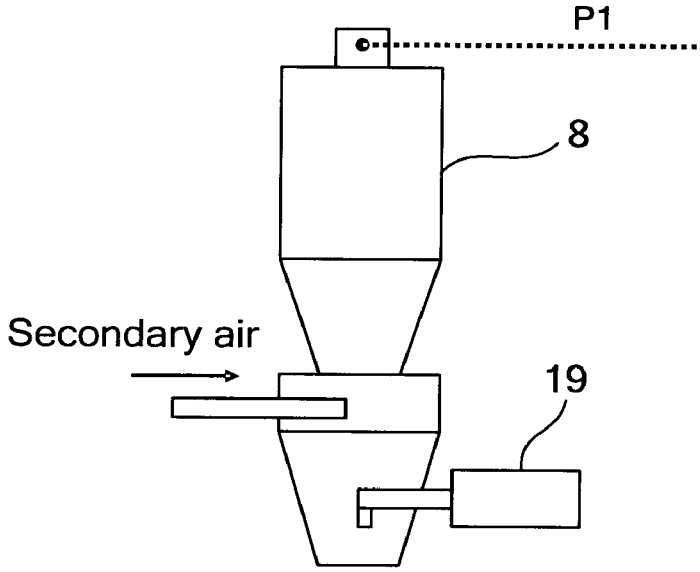
FIG. 21 shows an another enlarged view of the second cyclone unit and the narrowing part in FIG. 19.

In the flow of the milling and classifying step shown in FIG. 19, as shown in FIG. 21 the amount of the particles in the second cyclone unit 8 to which the particles are returned is adjusted by static pressure, in case that a primary static pressure of the upper part of the second cyclone unit 8, for example, the cylindrical part of the cyclone, is defined as P1, the primary static pressure P1 is preferably −10 kPa to −30 kPa, and more preferably −15 kPa to −25 kPa, in terms of the improvement of classification performance and yield. When the primary static pressure P1 is more than −10 kPa, the swirling force in the second cyclone unit may be decreased and the dispersing ability may be decreased. When the primary static pressure P1 is less than −30 kPa, the dispersing ability may be increased, but a yield may be decreased.

Figure 22:
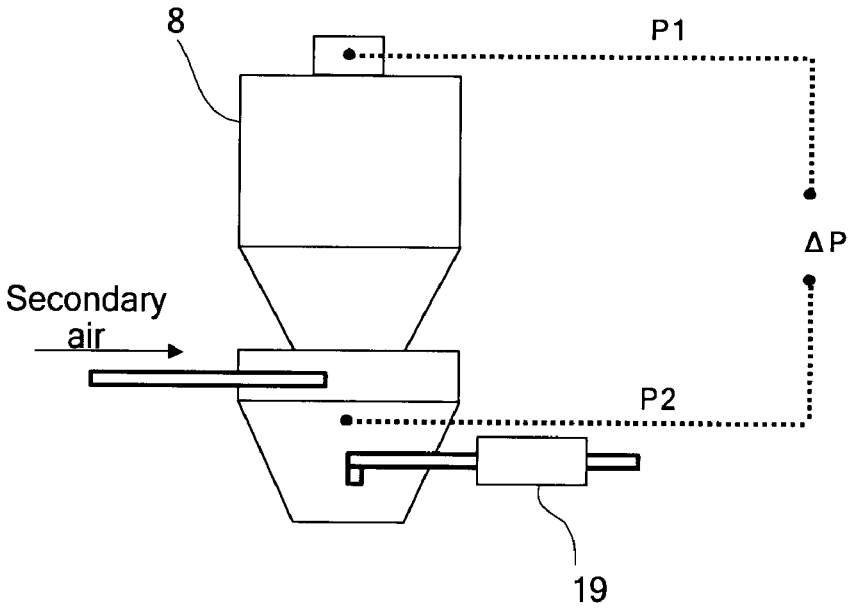
FIG. 22 shows a still another enlarged view of the second cyclone unit and the narrowing part in FIG. 19.

In the flow of the milling and classifying step shown in FIG. 19, as shown in FIG. 22 the amount of the particles in the second cyclone unit 8 to which the particles are returned is adjusted by static pressure, in case that the primary static pressure of the upper part of the second cyclone unit 8, for example, the cylindrical part of the cyclone, is defined as P1, a secondary static pressure of the lower part of the second cyclone unit 8, for example, the conical part of the cyclone, is defined as P2, and pressure difference ΔP ($|P1-P2|$) is preferably 5 kPa or less, and more preferably 1 kPa or less, in terms of the improvement of classification performance.

Figure 23:
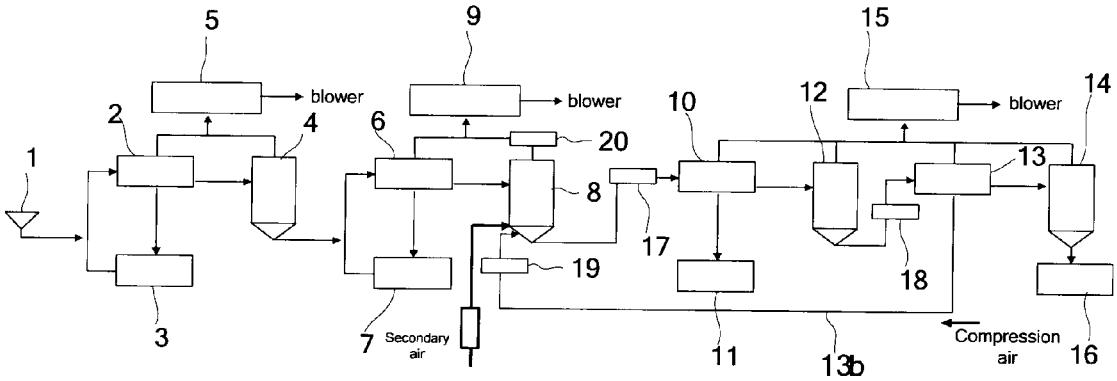
FIG. 23 shows an example of the flow of the milling and classifying step in Example 15.

The flow of the milling and classifying step shown in FIG. 23 is the same as the flow of the milling and classifying step shown in FIG. 19, except that the static pressure in the second cyclone unit 8 to which the particles are returned is adjusted by the secondary air flow rate.

In the flow of the milling and classifying step shown in FIG. 23, the static pressure in the second cyclone unit 8 to which the particles are returned is adjusted by the secondary air flow rate, and the secondary air flow rate is preferably 300 L/min to 1,200 L/min, and more preferably 300 L/min to 800 L/min. When the secondary air flow rate is more than 1,200 L/min, the classification performance may be decreased.

Figure 24:
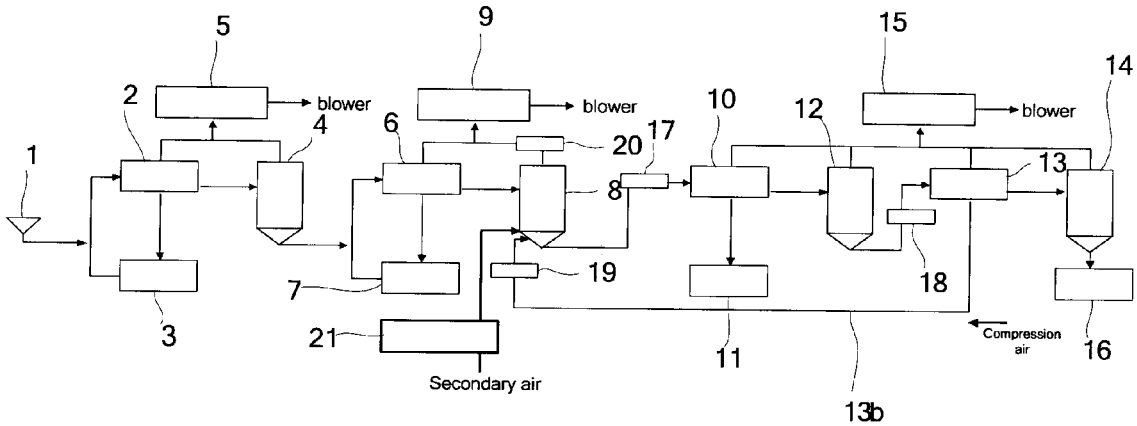
FIG. 24 shows an example of the flow of the milling and classifying step in Examples 16 to 17.

The flow of the milling and classifying step shown in FIG. 24 is the same as the flow of the milling and classifying step shown in FIG. 19, except that the secondary air flow rate in the second cyclone unit 8 to which the particles are returned is adjusted by an automatic adjustment device 21.

In the flow of the milling and classifying step shown in FIG. 24, the classification performance may be improved by adjusting the secondary air flow rate in the second cyclone unit 8 to which the particles are returned by the automatic adjustment device 21.

The automatic adjustment device is not limited, and may be appropriately selected depending on the purpose. For example, a unit configured to convert the pressure difference ΔP generated in the pipe arrangement to an electric signal, and adjust a valve by a controller.

Figure 25:
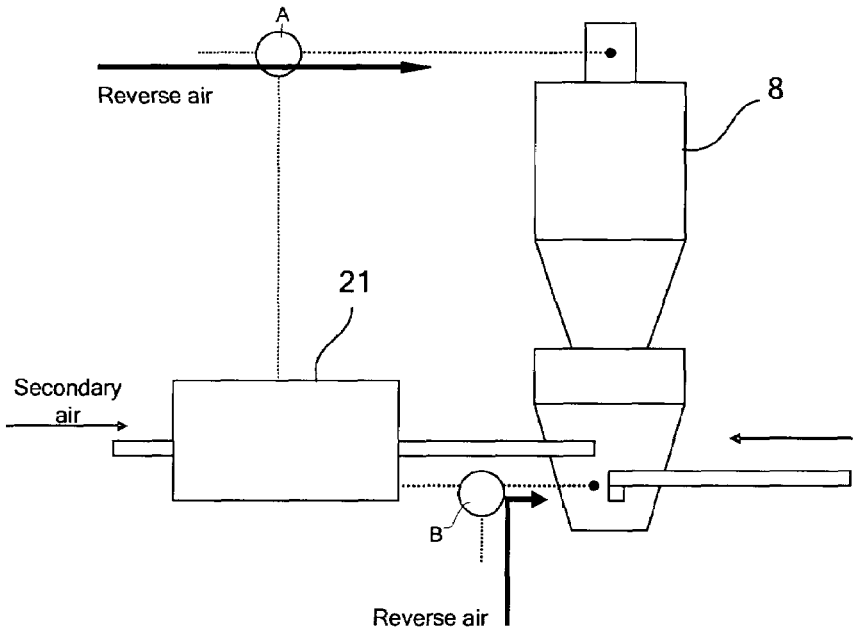
FIG. 25 shows an enlarged view of the second cyclone unit and the automatic adjustment device in FIG. 24.

In the flow of the milling and classifying step shown in FIG. 24, the automatic adjustment device 21 preferably equips a cleaning mechanism as shown in FIG. 25. The cleaning mechanism is not limited and may be appropriately selected depending on the purpose. For example, a unit configured to detect the pressure difference ΔP in the pipe arrangement and blow reverse air in the pipe arrangement at regular time intervals.

<Melt-Kneading Step>

Examples of the other steps include a melt-kneading step. In the melt-kneading step, the toner materials are mixed and the mixture is put in a melting kneader, and melt-kneaded. As the melting kneader, it is possible to use a uniaxis or two-axis-consecutive kneader, and a batch type kneader using a roll mill. Examples of the melting kneaders include KTK type two-axis extruder manufactured by Kobe Steel, Ltd.; a TEM type extruder manufactured by Toshiba Machine Co., Ltd.; a two-axis extruder manufactured by KCK; a PCM type two-axis extruder manufactured by Ikegai, Ltd.; and a Co-kneader manufactured by Buss. It is preferred that these melting kneaders be used under appropriate conditions that does not bring separation of molecular chain of the binder resin. Specifically, when the melt-kneading temperature is excessively higher than the softening point of the binder resin, molecular chains are bitterly separated. When the melt-kneading temperature may be excessively lower than the softening point of the binder resin, the dispersion may not proceed.

The toner material at least contains a binder resin, a colorant, a releasing agent, and a charge controlling agent, and further contains other components as necessary.

—Binder Resin—

Examples of the binder resins include homopolymers and copolymers, and specific examples thereof include styrenes such as styrene and chlorostyrene; monoolefins such as ethylene, propylene, butylene, isoprene; vinyl esters such as vinyl acetate, vinyl propionate, vinyl benzoate, vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate; vinyl ethers such as vinyl methyl ether, vinyl ethyl ether, vinyl butyl ether; vinyl ketones such as vinyl methyl ketone, vinyl hexyl ketone, vinyl isopropenyl ketone.

Examples of the typical binder resins include a polystyrene resin, a polyester resin, a styrene-acrylate copolymer, a styrene-alkyl acrylate copolymer, styrene-methacrylate alkyl copolymer, styrene-acrylonitrile copolymer, a styrene-butadiene copolymer, a styrene-maleic anhydride copolymer, a polyethylene resin, and polypropylene resin. These may be used alone or in combination.

—Colorant—

The colorant is not particularly limited and may be appropriately selected from the known dyes and pigments depending on the purpose. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and a combination thereof. These may be used alone or in combination.

The colors of the colorants are not particularly limited and may be appropriately selected depending on the purpose, for example, black pigments and color pigments. These may be used alone or in combination.

Examples of colorants for black include carbon black (C.I. pigment black 7) such as furnace black, lamp black, acetylene black and channel black, metals such as copper, iron (C.I. pigment black 11) and titanium oxide, and organic pigments such as aniline black (C.I. pigment black 1). Examples of colorants for magenta include C.I. pigment red 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211; C.I. pigment violet 19; C.I. vat red 1, 2, 10, 13, 15, 23, 29, 35.

Examples of coloring pigments for cyan include C.I. pigment blue 2, 3, 15, 15:1, 15:2, 15:3, 15:4, 15:6, 16, 17, 60; C.I. vat blue 6; C.I. acid blue 45, copper phthalocyanine pigment having a phthalocyanine skeleton substituted with 1-5 phthalimide methyl groups, green 7, and green 36.

Example of coloring pigments for yellow include C.I. pigment yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. vat yellow 1, 3, 20, and Orange 36.

The content of the colorant in the toner is not limited, and may be appropriately selected depending on the purpose. It is preferably 1% by mass to 15% by mass, and more preferably 3% by mass to 10% by mass. When the content is less than 1% by mass, the coloring power of the toner may be decreased. When the content is more than 15% by mass, the pigment may be failed to disperse in the toner, the coloring power may be decreased, and the electric property of the toner may be decreased.

The colorant may be used as a master batch in a composite with a resin as well. The resins are not limited and may be appropriately selected from the known resins depending on the purpose. Examples thereof include a styrene and a polymer of the substitution product thereof, styrene copolymers, a polymethylmethacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, a polyacrylic acid resin, rosin, modified rosin, a terpene resin, a aliphatic or alicyclic hydrocarbon resin, an aromatic petroleum resin, chlorinated paraffin and paraffin wax. These may be used alone or in combination.

Examples of the styrenes and polymers of the substitution product include a polyester resin, a polystyrene resin, a poly (p-chlorostyrene) resin and a polyvinyltoluene resin. Examples of styrene copolymers include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloromethyl methacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer, a styrene-maleic acid copolymer, and a styrene-maleate copolymer.

The master batch can be prepared by mixing or kneading a resin for the master batch and the colorant under high shearing force. In this procedure, an organic solvent is preferably used for higher interaction between the colorant and the resin. In addition, a "flushing process" is preferably employed, in which an aqueous paste containing the colorant and water is mixed and kneaded with a resin and an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used for mixing or kneading.

—Releasing Agent—

The releasing agent is not limited, and may be appropriately selected from the know releasing agents depending on the purpose. Example thereof include waxes such as carbonyl group-containing wax, polyolefin wax, and long-chain hydrocarbon. These may be used alone or in combination.

Examples of the carbonyl group-containing wax include polyalkanoic acid esters, polyalkanol esters, polyalkanoic acid amides, polyalkylamides, and dialkyl ketones. Examples of the polyalkanol esters include carnauba wax, montan wax, trimethylolpropane tribehenate, pentaerythritol tetrabehenate, pentaerythritol diacetate dibehenate, glycerol tribehenate, and 1,18-octadecanediol distearate. Examples of the polyalkanol esters include tristearyl trimellitate, and distearyl maleate. Examples of the polyalkanoic acid amides include dibehenyl amide. Examples of the polyalkylamides include tristearylamide trimellitate. Examples of the dialkyl ketones include distearyl ketone. Of these carbonyl group-containing wax, polyalkanoic acid esters are preferably used.

Examples of the polyolefin wax include polyethylene wax and polypropylene wax.

Examples of the long-chain hydrocarbon include paraffin wax and Sasol wax.

The content of the releasing agent in the toner is not particularly limited and may be appropriately selected depending on the purpose. It is preferably 0% by mass to 40% by mass, and more preferably 3% by mass to 30% by mass. When the content is more than 40% by mass, the flowability of the toner may be adversely affected.

—Charge Controlling Agent—

The charge controlling agent is not particularly limited, and may be appropriately selected from the known charge controlling agents depending on the purpose. The charge controlling agent is preferably made of a material having color close to transparent and/or white because colored materials may change color tone. Examples thereof include triphenylmethane dye, molybdic acid chelate pigment, rhodamine dye, alkoxy amine, a quaternary ammonium salt such as a fluorine-modified quaternary ammonium salt, alkylamide, a phosphoric simple substance or a compound thereof, a tungsten simple substance or a compound thereof, a fluorine-containing active agent, a metal salt of salicylic acid, and a metal salt of salicylic acid derivative. These may be used alone or in combination.

Examples of the charge controlling agents include commercially available products under the trade names of Bontron P-51 of a quaternary ammonium salt, Bontron E-82 of an oxynaphthoic acid metal complex, Bontron E-84 of a salicylic acid metal complex, Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron complex (by Japan Carlit Co., Ltd.); quinacridone, azo pigment; and other high-molecular mass compounds having a functional group such as a sulfonic acid group, a carboxyl group and a quaternary ammonium salt.

The charge controlling agent may be dissolved and/or dispersed in the toner material after melt kneading with the master batch. The charge controlling agent may also be added directly at the time of dissolving and/or dispersing in an organic solvent together with the toner material. In addition, the charge controlling agent may be added onto the surface of the toner particle after the toner particle is produced.

The content of the charge controlling agent in the toner is determined depending on the kinds of the binder resins, presence or absence of additives used accordingly and the methods for producing the toner including a dispersing method and is not defined unambiguously. The content of the charge controlling agent is preferably 0.1 parts by mass to 10 parts by mass, and more preferably 0.2 parts by mass to 5 parts by mass based on 100 parts by mass of the binder resin. When the content of the charge controlling agent is less than 0.1 parts by mass, the charge may not be appropriately controlled. When the content of the charge controlling agent is more than 10 parts by mass, the effect of the charge controlling agent is weakened and electrostatic suction force to the developing roller is increased due to too much charging ability of the toner, which may lead to the reduction of flowability of the developer or image density.

—Other Components—

The other components are not particularly limited, and may be appropriately selected depending on the purpose. Examples thereof include an external additive, a flow improver, a cleaning improver, a magnetic material, and a metal soap.

The external additive is not limited, and may be appropriately selected from the know external additives depending on the purpose. Example thereof include silica fine particles, hydrophobized silica fine particles, fatty acid metal salts such as zinc stearate, aluminum stearate; metallic oxide such as titania, alumina, tin oxide, antimony oxide, and hydrophobized product thereof, and fluoropolymer. Among these, the hydrophobized silica fine particles, titania particles, and hydrophobized titania particles are preferred.

The toner of the present invention is produced by the method for producing the toner of the invention.

The content of the pulverized particles having a particle diameter of 4.0 μm or less in the toner is preferably 5 number average % to 25 number average %, and more preferably 18 number average % to 22 number average %. When the content of the pulverized particles having a particle diameter of 4.0 μm or less is less than 5 number average %, the pulverized particles are excessively removed, and a yield may be decreased. When the content of the pulverized particles having a particle diameter of 4.0 μm or less is more than 25 number average %, background smear may occur when the toner is used for copying.

The mass average particle diameter of the toner is preferably 5.0 μm to 12.0 μm, and more preferably 6.5 μm to 10.0 μm. The number average particle diameter is preferably 4.0 μm to 11.0 μm, and more preferably 5.5 μm to 9.0 μm.

The particle diameter distribution and average particle diameter is measured by, for example, a particle size analyzer "Coulter Multisizer III" by coulter electronics Ltd.

According to the present invention, the conventional problem can be solved, and it is possible to provide a method for producing a toner and a toner produced by the method which is excellent in productivity and economic efficiency, in which in the milling and classifying step of the toner (finely milling particles and classifying coarse particles, classifying pulverized particles), the pulverized particles contained more than required in the toner as a product are accurately classified, without adding a classifier in the step, by giving an additional function to the present condition, and the toner having excellent quality property can be stably and easily produced by using the method.

EXAMPLES

The examples of the present invention will be explained hereinafter, but the present invention is not limited to these examples.

Example 1

Preparation of Toner Material

The toner material consisting of 50% by mass of a polyester resin, 30% by mass of a styrene-acrylate copolymer, 15% by mass of carbon black, 4.5% by mass of wax and 0.5% by mass of a charge controlling agent was melt-kneaded, cooled, solidified, and then coarsely milled with a hammer mill to prepare a toner raw material.

—Milling and Classifying—

The toner raw material was milled and classified according to the flow of the milling and classifying step shown in FIG. 2. In the flow shown in FIG. 2, any of the pulverized particles and other particles were returned through a return pipe 13*b* to the second cyclone unit 8 in the milling step from a fourth classifier 13 in the classifying step. In the second cyclone unit 8 a double cyclone was used.

The particles were milled and classified for 5 hours according to the flow of the milling and classifying step shown in FIG. 2, the particle diameter and the particle diameter distribution of the particles were measured every 30 minutes as explained hereinbelow. The toner had a number average particle diameter of 7.0 μm, a mass average particle diameter of 9.0 μm, a content of the pulverized particles having a particle diameter of 4.0 μm or less of 24.0 number average % (standard deviation σ=2.4), and a yield of 87.0%.

<Measurement of Particle Diameter and Particle Diameter Distribution>

The particle diameter and particle diameter distribution were measured using the Coulter Counter method by means of Coulter Multisizer III (manufactured by Beckmann Coulter Inc.) as a measurement device of toner particles distribution as follows:

First, as a dispersing agent, 0.1 ml to 5 ml of a surfactant (alkylbenzene sulfonate) was added to 100 ml to 150 ml of an electrolytic solution. The electrolytic solution was a 1 mass % aqueous solution of NaCl prepared using primary sodium chloride (ISOTON-II by Beckmann Coulter Inc.). Subsequently, 2 mg to 20 mg of sample to be measured was further added. The sample suspension was sonicated for 1 minute to 3 minutes using an ultrasonicator. Using the measurement instrument of 100 μm-aperture, the mass and the number of toner particles were measured to obtain its mass distribution and number distribution, from which the mass average particle diameter, the number average particle diameter, and the content of the pulverized particles having a particle diameter of 4.0 μm or less of the toner were obtained.

For channels, 13 different channels were used—from 2.00 μm or more to less than 2.52 μm; from 2.52 μm or more to less than 3.17 μm; from 3.17 μm or more to less than 4.00 μm; from 4.00 μm or more to less than 5.04 μm; from 5.04 μm or more to less than 6.35 μm; from 6.35 μm or more to less than 8.00 μm; from 8.00 μm or more to less than 10.08 μm; from 10.08 μm or more to less than 12.70 μm; from 12.70 μm or more to less than 16.00 μm; from 16.00 μm or more to less than 20.20 μm; from 20.20 μm or more to less than
25.40 μm; from 25.40 μm or more to less than 32.00 μm; and from 32.00 μm or more to less than 40.30 μm—targeting particles having a diameter of 2.00 μm or more to less than 40.30 μm.

Comparative Example 1

The same toner raw material as in the Example 1 was milled and classified according to the conventional flow of the milling and classifying step shown in FIG. 1 to produce a toner.

In the flow shown in FIG. 1, any of the pulverized particles and other particles from the fourth classifier 13 in the classifying step were returned to the third classifier 10 in the classifying step through the return pipe 13*a*.

According to the flow of the milling and classifying step shown in FIG. 1, the particles were milled and classified for 5 hours, and the particle diameter and the particle diameter distribution of the particles were measured every 30 minutes in the same manner as in the Example 1. The toner had a number average particle diameter of 6.5 μm, a mass average particle diameter of 8.8 μm, a content of the pulverized particles having a particle diameter of 4.0 μm or less of 26.0 number average % (standard deviation σ=3.0), and a yield of 85.0%.

Example 2

The same toner raw material as in the Example 1 was milled and classified according to the flow of the milling and classifying step shown in FIG. 2 to produce a toner as follows:

In Example 2, the amount of the particles in the second cyclone unit 8 to which the particles were returned was adjusted at a constant value in a range of 15% to 35% of the total volume of the second cyclone unit, and then the particles were milled and classified for 5 hours, and the particle diameter and the particle diameter distribution of the particles were measured every 30 minutes in the same manner as in the Example 1. The toner had a number average particle diameter of 7.2 μm, a mass average particle diameter of 9.0 μm, a content of the pulverized particles having a particle diameter of 4.0 μm or less of 24.0 number average % (standard deviation σ=2.0), and a yield of 88.0%.

Alternatively, the amount of the particles in the second cyclone unit 8 to which the particles were returned was adjusted at a constant value in a range of 20% to 30% of the total volume of the second cyclone unit, and then the particles were milled and classified for 5 hours, and the particle diameter and the particle diameter distribution of the particles were measured every 30 minutes in the same manner as in the Example 1. The toner had a number average particle diameter of 7.2 μm, a mass average particle diameter of 9.0 μm, a content of the pulverized particles having a particle diameter of 4.0 μm or less of 24.0 number average % (standard deviation (σ=2.0), and a yield of 88.0%.

Alternatively, the amount of the particles in the second cyclone unit 8 to which the particles were returned was adjusted at a constant value in a range of 22% to 28% of the total volume of the second cyclone unit, and then the particles were milled and classified. The toner had a number average particle diameter of 7.3 μm, a mass average particle diameter of 9.0 μm, a content of the pulverized particles having a particle diameter of 4.0 μm or less of 24.0 number average % (standard deviation (σ=1.8), and a yield of 88.5%.

Example 3

The same toner raw material as in the Example 1 was milled and classified according to the flow of the milling and classifying step shown in FIG. 3 to produce a toner as follows:

The flow of the milling and classifying step shown in FIG. 3 was the same flow of the milling and classifying step as shown in FIG. 2, except that the narrowing part 17 as shown in FIG. 6 was disposed in the particles introducing pipe of the third classifier 10 as shown in FIG. 4, and the narrowing part 18 as shown in FIG. 6 was disposed in the particles introducing pipe of the fourth classifier 13 as shown in FIG. 5.

The cross section of the narrowing part A2 was set at a constant value in a range from 1×(A1/20) to 10×(A1/20), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.06 μm, a content of the pulverized particles having a particle diameter of 4.0 μm or less of 22.0 number average % (standard deviation σ32 1.6), and a yield of 89.5%.

Example 4

The same toner raw material as in the Example 1 was milled and classified according to the flow of the milling and classifying step shown in FIG. 7 to produce a toner as follows:

The flow of the milling and classifying step shown in FIG. 7 was the same as the flow of the milling and classifying step shown in FIG. 3, except that the narrowing part 19 was disposed in the return pipe returning the particles to the second cyclone unit 8 in the flow of the milling and classifying step shown in FIG. 3.

In the flow the milling and classifying step shown in FIG. 7, the narrowing part 19 was disposed in the return pipe to the second cyclone unit 8 as shown in FIG. 8, the cross section of the narrowing part 19 or B2 as shown in FIG. 9 was set at a constant value in a range from 1×(B1/20) to 10×(B1/20), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.05 μm, a content of the pulverized particles having a particle diameter of 4.0 μm or less of 22.0 number average % (standard deviation σ=1.4), and a yield of 89.5%.

Alternatively, the cross section of the narrowing part B2 was set to be 10×(B1/20), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.0 μm, a content of the pulverized particles having a particle diameter of 4.0 μm or less of 22.0 number average % (standard deviation σ=1.4), and a yield of 89.5%.

Example 5

The same toner raw material as in the Example 1 was milled and classified according to the flow of the milling and classifying step shown in FIG. 10 to produce a toner as follows:

The flow of the milling and classifying step shown in FIG. 10 was the same as the flow of the milling and classifying step shown in FIG. 7, except that the narrowing part 20 was disposed in the upper suction pipe of the second cyclone unit 8 to which the particles were returned.

In the flow the milling and classifying step shown in FIG. 10, the narrowing part 20 was disposed in the upper suction pipe of the second cyclone unit 8 as shown in FIG. 11, the cross section of the narrowing part 20 or D2 as shown in FIG. 12 was set at a constant value in a range from 10×(D1/20) to 1×(D1/20), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.0 μm, a content of the pulverized particles having a particle diameter of 4.0 μm or less of 22.0 number average % (standard deviation σ=1.4), and a yield of 90.0%.

Example 6

The same toner raw material as in the Example 1 was milled and classified according to the flow of the milling and classifying step shown in FIG. 13 to produce a toner as follows:

The flow of the milling and classifying step shown in FIG. 13 was the same as the flow of the milling and classifying step shown in FIG. 7, except that that the narrowing part 20 was disposed in the upper suction pipe of the second cyclone unit 8.

In the flow of the milling and classifying step shown in FIG. 13, as shown in FIG. 14 the cross section of the return pipe returning the particles to the second cyclone unit 8 to which the particles are returned or C2 to the cross section of the cylindrical part of the second cyclone unit 8 or C1 was set to be 200×(C1/2000), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.0 μm, a content of the pulverized particles having a particle diameter of 4.0 μm or less of 22.0 number average % (standard deviation (σ=1.2), and a yield of 90.0%.

Alternatively, the cross section of the return pipe C2 to the cross section of the cylindrical part of the second cyclone unit 8 C1 was set to be 1×(C1/2000), and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.0 μm, a content of the pulverized particles having a particle diameter of 4.0 μm or less of 22.0 number average % (standard deviation (σ=1.2), and a yield of 90.0%.

Example 7

The same toner raw material as in the Example 1 was milled and classified according to the flow of the milling and classifying step shown in FIG. 13 to produce a toner as follows:

In the flow of the milling and classifying step shown in FIG. 13, as shown in FIG. 15 the insert angle θ of the return pipe returning the particles to the second cyclone unit 8 relative to the vertical perpendicular line P to the insert position was adjusted at a constant value in a range from 30° to 90°, and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.08 μm, a content of the pulverized particles having a particle diameter of 4.0 μm or less of 21.5 number average % (standard deviation σ=1.2), and a yield of 90.0%.

Alternatively, the insert angle θ was set at 150°, and then the particles were milled and classified for 5 hours, and the particle diameter and the particle diameter distribution of the particles were measured every 30 minutes in the same manner as in the Example 1. The toner had a number average particle diameter of 7.3 μm, a mass average particle diameter of 9.1 μm, a content of the pulverized particles having a particle diameter of 4.01 μm or less of 23.0 number average % (standard deviation σ=1.2), and a yield of 89.5%.

Example 8

The same toner raw material as in the Example 1 was milled and classified according to the flow of the milling and classifying step shown in FIG. 13 to produce a toner as follows:

In the flow the milling and classifying step shown in FIG. 13, as shown in FIG. 16 the height from the bottom of the conical part to the top of the cylindrical part in the second cyclone unit 8 to which the particles were returned was defined as L1, the height from the insert position of the return pipe returning the particles to the second cyclone unit 8 to the top of the cylindrical part of the second cyclone unit 8 was defined as L2, and L1 and L2 preferably satisfied the following relation: 1×(L1/10)≦L2≦3×(L1/10), were maintained at a constant value, and then the particles were milled and classified for 5 hours, and the particle diameter and the particle diameter distribution of the particles were measured every 30 minutes in the same manner as in the Example 1. The toner had a number average particle diameter of 7.45 μm, a mass average particle diameter of 9.08 μm, a content of the pulverized particles having a particle diameter of 4.0 μm or less of 21.0 number average % (standard deviation σ=1.2), and a yield of 90.0%.

Alternatively, the position of the return pipe L2 was set to be 9×(L1/10), and then the particles were milled and classified for 5 hours, and the particle diameter and the particle diameter distribution of the particles were measured every 30 minutes in the same manner as in the Example 1. The toner had a number average particle diameter of 7.3 μm, a mass average particle diameter of 9.05 μm, a content of the pulverized particles having a particle diameter of 4.0 μm or less of 22.0 number average % (standard deviation σ=1.2), and a yield of 89.0%.

Example 9

The same toner raw material as in the Example 1 was milled and classified according to the flow of the milling and classifying step shown in FIG. 17 to produce a toner as follows:

The flow the milling and classifying step shown in FIG. 17 was the same as the flow of the milling and classifying step shown in FIG. 13, except that the secondary air pipe was disposed on the second cyclone unit 8 to which the particles were returned.

In the flow the milling and classifying step shown in FIG. 17, for the adjustment of the amount of the particles in the second cyclone unit 8 the particles were milled and classified for 5 hours using the secondary air of atmospheric pressure, and the particle diameter and the particle diameter distribution of the particles were measured every 30 minutes in the same manner as in the Example 1. The toner had a number average particle diameter of 7.5 μm, a mass average particle diameter of 9.01 μm, a content of the pulverized particles having a particle diameter of 4.01 μm or less of 20.0 number average % (standard deviation σ=1.2), and a yield of 90.0%.

Example 10

The same toner raw material as in the Example 1 was milled and classified according to the flow of the milling and classifying step shown in FIG. 18 to produce a toner as follows:

In the flow the milling and classifying step shown in FIG. 18, for the adjustment of the amount of the particles in the second cyclone unit 8 to which the particles were returned, the blower flow of the second collector 9 was adjusted to 85% of the maximum flow, maintained at a constant value, and then the particles were milled and classified for 5 hours, and the particle diameter and the particle diameter distribution of the power were measured every 30 minutes in the same manner as in the Example 1. The toner had a number average particle diameter of 7.5 μm, a mass average particle diameter of 9.0 μm, a content of the pulverized particles having a particle diameter of 4.0 μm or less of 21.0 number average % (standard deviation (σ=1.2), and a yield of 90.5%.

The blower flow of the second collector 9 was adjusted to 70% of the maximum flow, maintained at a constant value, and then the particles were milled and classified for 5 hours, and the particle diameter and the particle diameter distribution of the particles were measured every 30 minutes in the same manner as in the Example 1. The toner had a number average particle diameter of 7.4 μm, a mass average particle diameter of 9.1 μm, a content of the pulverized particles having a particle diameter of 4.0 μm or less of 24.0 number average % (standard deviation σ=1.2), and a yield of 89.0%.

Example 11

The same toner raw material as in the Example 1 was milled and classified according to the flow of the milling and classifying step shown in FIG. 19 to produce a toner as follows:

The flow of the milling and classifying step shown in FIG. 19 was the same as the flow of the milling and classifying step shown in FIG. 18, except that the compression air was added from the fourth classifier 13 to the second cyclone unit 8 to which the particles were returned.

In the flow of the milling and classifying step shown in FIG. 19, for the adjustment (classification) of the amount of the particles in the second cyclone unit 8 to which the particles were returned, the compression air pressure (flow rate) from the fourth classifier 13 was adjusted at a constant value in a range from 0.4 MPa to 0.6 MPa (1.5 $m^3$/min to 2.5 $m^3$/min), and then the particles were milled and classified for 5 hours, and the particle diameter and the particle diameter distribution of the particles were measured every 30 minutes in the same manner as in the Example 1. The toner had a number average particle diameter of 7.5 μm, a mass average particle diameter of 9.1 μm, a content of the pulverized particles having a particle diameter of 4.0 μm or less of 20.5 number average % (standard deviation σ=1.2), and a yield of 90.5%.

Alternatively the compression air pressure (flow rate) was adjusted to 0.2 MPa (0.5 $m^3$/min), maintained at a constant value, and then the particles were milled and classified for 5 hours, and the particle diameter and the particle diameter distribution of the particles were measured every 30 minutes in the same manner as in the Example 1. The toner had a number average particle diameter of 7.5 μm, a mass average particle diameter of 9.1 μm, a content of the pulverized particles having a particle diameter of 4.0 μm or less of 20.5 number average % (standard deviation (σ=1.4), and a yield of 90.5%.

Example 12

The same toner raw material as in the Example 1 was milled and classified according to the flow of the milling and classifying step shown in FIG. 19 to produce a toner as follows:

In the flow of the milling and classifying step shown in FIG. 19, as shown in FIG. 20 the positional relation among the position E2 where the secondary air pipe was disposed on the second cyclone unit 8 to which the particles were returned, the position E1 where the return pipe was disposed on the second cyclone unit 8, and the position of surface of particles E0 of the particles in the second cyclone unit 8 was adjusted to satisfy the following range: E0≧E1≧E2, maintained at a constant value, and then the particles were milled and classified for 5 hours, and the particle diameter and the particle diameter distribution of the particles were measured every 30 minutes in the same manner as in the Example 1. The toner had a number average particle diameter of 7.3 μm, a mass average particle diameter of 9.1 μm, a content of the pulverized particles having a particle diameter of 4.0 μm or less of 24.0 number average % (standard deviation σ=2.0), and a yield of 88.5%.

Alternatively, the positional relation was adjusted to satisfy the following range: E0≦50 mm+E1≦50 mm+E2, maintained at a constant value, and then the particles were milled and classified for 5 hours, and the particle diameter and the particle diameter distribution of the particles were measured every 30 minutes in the same manner as in the Example 1. The toner had a number average particle diameter of 7.5 μm, a mass average particle diameter of 9.1 μm, a content of the pulverized particles having a particle diameter of 4.01 μm or less of 20.5 number average % (standard deviation σ=1.2), and a yield of 90.5%.

Example 13

The same toner raw material as in the Example 1 was milled and classified according to the flow of the milling and classifying step shown in FIG. 19 to produce a toner as follows:

In the flow the milling and classifying step shown in FIG. 19, as shown in FIG. 21 the primary static pressure P1 in the second cyclone unit 8 to which the particles were returned was adjusted at a constant value in a range from −10 kPa to −30 kPa, and then the particles were milled and classified for 5 hours, and the particle diameter and the particle diameter distribution of the particles were measured every 30 minutes in the same manner as in the Example 1. The toner had a number average particle diameter of 7.55 μm, a mass average particle diameter of 9.1 μm, a content of the pulverized particles having a particle diameter of 4.0 μm or less of 20.0 number average % (standard deviation σ=1.2), and a yield of 90.5%.

Alternatively, the primary static pressure P1 in the second cyclone unit 8 was adjusted to be −30 kPa, maintained at a constant value, and then the particles were milled and classified for 5 hours, and the particle diameter and the particle diameter distribution of the particles were measured every 30 minutes in the same manner as in the Example 1. The toner had a number average particle diameter of 7.5 μm, a mass average particle diameter of 9.2 μm, a content of the pulverized particles having a particle diameter of 4.0 μm or less of 18.0 number average % (standard deviation σ=1.2), and a yield of 87.5%.

Example 14

The same toner raw material as in the Example 1 was milled and classified according to the flow of the milling and classifying step shown in FIG. 19 to produce a toner as follows:

In the flow of the milling and classifying step shown in FIG. 19, as shown in FIG. 22, the pressure difference ΔP(|P1−P2|) in the second cyclone unit 8 to which the particles were returned was adjusted to 1 kPa, maintained at a constant value, and then the particles were milled and classified for 5 hours, and the particle diameter and the particle diameter distribution of the particles were measured every 30 minutes in the same manner as in the Example 1. The toner had a number average particle diameter of 7.55 μm, a mass average particle diameter was 9.1 μm, a content of the pulverized particles having a particle diameter of 4.0 μm or less of 19.5 number average % (standard deviation σ=1.2), and a yield of 90.5%.

Alternatively, the pressure difference ΔP (|P1−P2 |) in the second cyclone unit 8 was adjusted to 5 kPa, maintained at a constant value, and then the particles were milled and classified for 5 hours, and the particle diameter and the particle diameter distribution of the particles were measured every 30 minutes in the same manner as in the Example 1. The toner had a number average particle diameter of 7.5 μm, a mass average particle diameter of 9.2 μm, a content of the pulverized particles having a particle diameter of 4.0 μm or less of 17.5 number average % (standard deviation σ=1.2), and a yield of 87.5%.

Example 15

The same toner raw material as in the Example 1 was milled and classified according to the flow of the milling and classifying step shown in FIG. 23 to produce a toner as follows:

The flow of the milling and classifying step shown in FIG. 23 was the same as the flow of the milling and classifying step shown in FIG. 19, except that the static pressure in the second cyclone unit 8 to which the particles were returned was adjusted by the secondary air flow rate.

In the flow of the milling and classifying step shown in FIG. 23, the static pressure in the second cyclone unit 8 to which the particles were returned was adjusted to the secondary air flow rate of 300 L/min, maintained at a constant value, and then the particles were milled and classified for 5 hours, and the particle diameter and the particle diameter distribution of the particles were measured every 30 minutes in the same manner as in the Example 1. The toner had a number average particle diameter of 7.55 μm, a mass average particle diameter of 9.1 μm, a content of the pulverized particles having a particle diameter of 4.0 μm or less of 19.5 number average % (standard deviation (σ=1.2), and a yield of 90.5%.

Alternatively, the static pressure in the second cyclone unit 8 was adjusted to the secondary air flow rate of 400 L/min, maintained at a constant value, and then the particles were milled and classified for 5 hours, and the particle diameter and the particle diameter distribution of the particles were measured every 30 minutes in the same manner as in the Example 1. The toner had a number average particle diameter of 7.6 μm, a mass average particle diameter of 9.1 μm, a content of the pulverized particles having a particle diameter of 4.0 μm or less of 18.5 number average % (standard deviation σ=1.2), and a yield of 91.0%.

Moreover, the static pressure in the second cyclone unit 8 was adjusted to the secondary air flow rate of 1,200 L/min, maintained at a constant value, and then the particles were milled and classified for 5 hours, and the particle diameter and the particle diameter distribution of the particles were measured every 30 minutes in the same manner as in the Example 1. The toner had a number average particle diameter of 7.55 μm, a mass average particle diameter of 9.1 μm, a content of the pulverized particles having a particle diameter of 4.0 μm or less of 18.5 number average % (standard deviation (σ=1.2), and a yield of 90.0%.

Example 16

The same toner raw material as in the Example 1 was milled and classified according to the flow of the milling and classifying step shown in FIG. 24 to produce a toner as follows:

The flow of the milling and classifying step shown in FIG. 24 was the same as the flow of the milling and classifying step shown in FIG. 19, except that the secondary air flow rate in the second cyclone unit 8 to which the particles were returned was adjusted by means of an automatic adjustment device.

In the flow the milling and classifying step shown in FIG. 24, the secondary air flow rate in the second cyclone unit 8 was adjusted by the automatic adjustment device (a unit configured to automatically adjust the opening of a control valve) 21, and then the particles were milled and classified for 5 hours, and the particle diameter and the particle diameter distribution of the particles were measured every 30 minutes in the same manner as in the Example 1. The toner had a number average particle diameter of 7.65 μm, a mass average particle diameter of 9.1 μm, a content of the pulverized particles having a particle diameter of 4.0 μm or less of 18.5 number average % (standard deviation σ=0.8), and a yield of 91.5%.

Example 17

The same toner raw material as in the Example 1 was milled and classified according to the flow of the milling and classifying step shown in FIG. 24 to produce a toner as follows:

In the flow of the milling and classifying step shown in FIG. 24, a cleaning mechanism (a reverse air A and a reverse air B; intermittent injection of the compression air) was used for the automatic adjustment device 21 shown in FIG. 25, and then the particles were milled and classified for 5 hours, and the particle diameter and the particle diameter distribution of the particles were measured every 30 minutes in the same manner as in the Example 1. The toner had a number average particle diameter of 7.65 μm, a mass average particle diameter of 9.1 μm, a content of the pulverized particles having a particle diameter of 4.0 μm or less of 18.5 number average % (standard deviation σ=0.6), and a yield of 91.5%.

The particles returned to the second cyclone unit 8 to which the particles were returned had a mass average particle diameter of 4.8 μm, a number average particle diameter of 3.8 μm, and a content of the pulverized particles having a particle diameter of 4.0 μm or less of 73 number average %. The particles collected from the upper part of the second cyclone unit 8 to which the particles were returned had a mass average particle diameter of 3.6 μm, a number average particle diameter of 2.6 μm, and a content of the pulverized particles having a particle diameter of 4.0 μm or less of 90 number average %.

TABLE 1

| | Outline of content | Content of the fine particles having a particle diameter of 4.0 μm or less (number average %) | Variation of the content of the fine particles o (standard deviation) | Yield (%) |
|---|---|---|---|---|
| Comparative Example 1 | Return to the third classifier | 26.0 | 3.0 | 85.0 |

TABLE 1-continued

| | Outline of content | | Content of the fine particles having a particle diameter of 4.0 μm or less (number average %) | Variation of the content of the fine particles σ (standard deviation) | Yield (%) |
|---|---|---|---|---|---|
| Example 1 | Return to the second cyclone unit | | 24.0 | 2.4 | 87.0 |
| Example 2 | Adjustment of the | 15% to 35% | 24.0 | 2.0 | 88.0 |
| | amount of the powder in | 20% to 30% | 24.0 | 2.0 | 88.0 |
| | the second cyclone unit | 22% to 28% | 24.0 | 1.8 | 88.5 |
| Example 3 | Narrowing part of the classifier | | 22.0 | 1.6 | 89.5 |
| Example 4 | Narrowing part of the | 1 × (B1/20) to 10 × (B1/20) | 22.0 | 1.4 | 89.5 |
| | return pipe | 10 × (B1/20) | 22.0 | 1.4 | 89.5 |
| Example 5 | Narrowing part of the upper suction pipe of the second cyclone unit | | 22.0 | 1.4 | 90.0 |
| Example 6 | Cross section of the | 200 × (C1/2000) | 22.0 | 1.2 | 90.0 |
| | return pipe | 1 × (C1/2000) | 22.0 | 1.2 | 90.0 |
| Example 7 | Insert ange of the return | 30° to 90° | 21.5 | 1.2 | 90.0 |
| | pipe | 150° | 23.0 | 1.2 | 89.5 |
| Example 8 | Hight of the return pipe | 1 × (L1/10) to 3 × (L1/10) | 21.0 | 1.2 | 90.0 |
| | | 9 × (L1/10) | 22.0 | 1.2 | 89.0 |
| Example 9 | Use of the secondary air (atmospheric pressure) | | 20.0 | 1.2 | 90.0 |
| Example 10 | Adjustment of | 85% | 21.0 | 1.2 | 90.5 |
| | the blower flow | 70% | 24.0 | 1.2 | 89.0 |
| Example 11 | Adjustment of the | 0.4 MPa to 0.6 MPa | 20.5 | 1.2 | 90.5 |
| | compression air pressure | (1.5 to 2.5 $m^3$/min) | | | |
| | (flow rate) | 0.2 MPa | 20.5 | 1.4 | 90.5 |
| | | (0.5 $m^3$/min) | | | |
| Example 12 | Return pipe, secondary | E0 ≧ E1 ≧ E2 | 24.0 | 2.0 | 88.5 |
| | air, position of surface of | 50 mm | 20.5 | 1.2 | 90.5 |
| | particles | | | | |
| Example 13 | Control of the static | −10 kPa to −30 kPa | 20.0 | 1.2 | 90.5 |
| | pressure in the second | −30 kPa | 18.0 | 1.2 | 87.5 |
| | cyclone unit | | | | |
| Example 14 | Control of the pressure | 1 kPa | 19.5 | 1.2 | 90.5 |
| | difference in the second | 5 kPa | 17.5 | 1.2 | 87.5 |
| | cyclone unit | | | | |
| Example 15 | Adjustment of the | 300 L/min | 19.5 | 1.2 | 90.5 |
| | secondary air flow rate | 400 L/min | 18.5 | 1.2 | 91.0 |
| | | 1200 L/min | 18.5 | 1.2 | 90.0 |
| Example 16 | Automatic adjustment device | | 18.5 | 0.8 | 91.5 |
| Example 17 | Cleaning mechanism | | 18.5 | 0.6 | 91.5 |

As can be seen from the result of Table 1, in the milling and classifying step in Examples 1 to 17 the content of the pulverized particles having a particle diameter of 4 μm or less in the milled and classified toner is smaller compared with that in the conventional milling and classifying step (Comparative Example 1), thus the toner can be accurately and stably classified, and the yield of the toner product is improved.

The method for producing the toner of the present invention, contains the milling and classifying step of the toner (finely milling particles and classifying coarse particles, classifying pulverized particles), in which the pulverized particles contained more than required in the toner as a product are accurately classified without adding a classifier in the step, by giving an additional function to the present condition, and the toner having excellent quality property can be stably and easily produced, thus the method for producing a toner is excellent in productivity. Therefore, a toner for a latent electrostatic image having stable charge amount, and capable of obtaining excellent image quality can be provided.

What is claimed is:

1. A method for producing a toner, comprising:

a first milling step and a second milling step, each comprising finely milling particles and classifying coarse particles by using at least first and second mills and first and second cyclone units; and a classifying step comprising classifying pulverized particles by using at least first and second classifiers and third and fourth cyclone units, wherein any of the pulverized particles and other particles, which are classified by the second classifier in the classifying step and returned, are returned through a return pipe to the second cyclone unit in the second milling step.

2. The method for producing a toner according to claim 1, wherein the cyclone unit comprises a cyclone.

3. The method for producing a toner according to claim 1, wherein the amount of the particles in the cyclone unit to which the particles are returned is 15% to 35% of the total volume of the cyclone unit.

4. The method for producing a toner according to claim 1, wherein a particles introducing pipe comprises a narrowing part in the classifier in the classifying step, and a cross section of the particles introducing pipe A1 and a cross section of the narrowing part A2 satisfy the following relation:

$$1\times(A1/20)\leqq A2\leqq 10\times(A1/20).$$

5. The method for producing a toner according to claim 1, wherein a return pipe returning the particles to the cyclone unit comprises a narrowing part, and a cross section of the return pipe B1 and a cross section of the narrowing part B2 satisfy the following relation:

$$1\times(B1/20)\leqq B2\leqq 10\times(B1/20).$$

6. The method for producing a toner according to claim 1, wherein an upper suction pipe of the cyclone unit to which the particles are returned comprises a narrowing part, and a cross section of the upper suction pipe D1 and a cross section of the narrowing part D2 satisfy the following relation:

$$1\times(D1/20)\leqq D2\leqq 10\times(D1/20).$$

7. The method for producing a toner according to claim 1, wherein a cross section of the cylindrical part of the cyclone unit to which the particles are returned C1 and a cross section of the return pipe returning the particles to the cyclone unit C2 satisfy the following relation:

$$1\times(C1/2000)\leqq C2\leqq 200\times(C1/2000).$$

8. The method for producing a toner according to claim 1, wherein the insert angle θ of the return pipe returning the particles to the cyclone unit relative to the vertical perpendicular line to the insert position where the return pipe is inserted to the cyclone unit is 30° to 150°.

9. The method for producing a toner according to claim 1, wherein the height L1 from the bottom of the conical part to the top of the cylindrical part in the cyclone unit to which the particles are returned, and the height L2 from the insert position of the return pipe returning the particles to the cyclone unit to the top of the cylindrical part of the cyclone unit satisfy the following relation:

$$1\times(L1/10)\leqq L2\leqq 9\times(L1/10).$$

10. The method for producing a toner according to claim 1, wherein the amount of the particles in the cyclone unit to which the particles are returned is adjusted by a secondary air from a secondary air pipe disposed on the cyclone unit.

11. The method for producing a toner according to claim 10, wherein a position where the secondary air pipe is disposed on the cyclone unit to which the particles are returned is higher than any of a position where the return pipe is disposed on the cyclone unit and a surface of the particles in the cyclone unit.

12. The method for producing a toner according to claim 1, wherein the amount of the particles in the cyclone unit to which the particles are returned is adjusted by a blower flow of a collector located above the cyclone unit, and the blower flow is 70% or more of the maximum flow.

13. The method for producing a toner according to claim 1, wherein the amount of the particles in the cyclone unit to which the particles are returned is adjusted by compression air from the classifier in the classifying step, and the pressure of the compression air is 0.2 MPa to 0.6 MPa and the flow rate of the compression air is 0.5 $m^3$/min to 2.5 $m^3$/min.

14. The method for producing a toner according to claim 1, wherein the amount of the particles in the cyclone unit to which the particles are returned is adjusted by a static pressure, and a primary static pressure of the upper part of the cyclone unit P1 is −10 kPa to −30 kPa.

15. The method for producing a toner according to claim 14, wherein the amount of the particles in the cyclone unit to which the particles are returned is adjusted by the static pressure, and the pressure difference ΔP(|P1−P2|) between the primary static pressure of the upper part of the cyclone unit P1 and a secondary static pressure of the lower part of the cyclone unit P2 is 5 kPa or less.

16. The method for producing a toner according to claim 1, wherein a secondary air flow rate in the cyclone unit to which the particles are returned is adjusted by an automatic adjustment device.

17. The method for producing a toner according to claim 16, wherein the automatic adjustment device comprises a cleaning mechanism.

18. The method for producing a toner according to claim 1, wherein the particles returned to the cyclone unit have a mass average particle diameter of 5.5 μm or less, a number average particle diameter of 4.5 μm or less, and a content of the pulverized particles having a particle diameter of 4.0 μm or less of 40 number average % or more.

19. The method for producing a toner according to claim 1, wherein the particles collected from the upper part of the cyclone unit to which the particles are returned have a mass average particle diameter of 4.0 μm or less, a number average particle diameter of 3.0 μm or less, and a content of the pulverized particles having a particle diameter of 4.0 μm or less of 70 number average % or more.

20. The method for producing a toner according to claim 1, wherein at least a mill, a cyclone unit and a classifier are used in the milling step.

* * * * *